US011313115B2

(12) United States Patent
Hocaoglu et al.

(10) Patent No.: US 11,313,115 B2
(45) Date of Patent: Apr. 26, 2022

(54) FARMHOUSE SINK SYSTEM WITH A RIMLESS METALLIC SINK AND METHOD OF FORMING THE SAME

(71) Applicants: Mehmet Hocaoglu, Fort Lauderdale, FL (US); Yavuz Hocaoglu, Fort Lauderdale, FL (US)

(72) Inventors: Mehmet Hocaoglu, Fort Lauderdale, FL (US); Yavuz Hocaoglu, Fort Lauderdale, FL (US)

( * ) Notice: Subject to any disclaimer, the term of this patent is extended or adjusted under 35 U.S.C. 154(b) by 0 days.

(21) Appl. No.: 16/953,614

(22) Filed: Nov. 20, 2020

(65) Prior Publication Data

US 2021/0071400 A1 Mar. 11, 2021

Related U.S. Application Data

(63) Continuation-in-part of application No. 16/243,669, filed on Jan. 9, 2019, now Pat. No. 10,844,582.

(60) Provisional application No. 62/615,131, filed on Jan. 9, 2018.

(51) Int. Cl.
*E03C 1/33* (2006.01)

(52) U.S. Cl.
CPC ..... *E03C 1/335* (2013.01)

(58) Field of Classification Search
CPC ..... E03C 1/335
USPC ..... 4/430.619, 517, 546, 597, 625, 631; 211/134; 312/228, 281, 351, 313
See application file for complete search history.

(56) References Cited

U.S. PATENT DOCUMENTS

| | | | |
|---|---|---|---|
| 2,080,573 | A | 5/1937 | Madsen |
| 2,476,215 | A | 7/1949 | Patton |
| 2,495,853 | A | 1/1950 | Lindgren |
| 4,175,292 | A | 11/1979 | Morrison |
| 4,374,695 | A | 2/1983 | Ikeda et al. |
| 5,016,297 | A | 5/1991 | Sauter et al. |
| 5,551,103 | A | 9/1996 | Drozdowich et al. |
| 5,754,991 | A | 5/1998 | Drozdowich et al. |
| 5,997,009 | A | 12/1999 | Geise |
| 6,349,429 | B1 | 2/2002 | Zurba et al. |
| 6,571,406 | B2 | 6/2003 | Gerloff |
| 6,986,174 | B2 | 1/2006 | Brown |
| 7,007,317 | B1 | 3/2006 | Brown |

(Continued)

FOREIGN PATENT DOCUMENTS

| | | |
|---|---|---|
| BR | 102015020203 | 2/2016 |
| CA | 2707848 | 6/2004 |

(Continued)

*Primary Examiner* — Lori L Baker
(74) *Attorney, Agent, or Firm* — Mark C. Johnson; Johnson Dalal

(57) ABSTRACT

A farmhouse sink system with a rimless metallic sink that includes a farmhouse sink frame having a sidewall with a top surface for mounting underneath a lower surface of a countertop, defining a sink frame access opening therethrough, and an upper lip extending laterally inward toward the sink frame access opening on at least two opposing sides, of the sidewall of the farmhouse sink frame. A metallic sink is disposed within the sink frame access opening, that defines at least one bowl, and has a mounting flange member laterally extending outwardly from an outer sidewall surface of the sidewall of the metallic sink, and a rimless upper edge disposed along and around the sidewall of the metallic sink and superimposed by the upper lip of the farmhouse sink frame. Further, a sink mounting frame assembly is utilized to support the metallic sink on a support surface.

19 Claims, 17 Drawing Sheets

(56) References Cited

U.S. PATENT DOCUMENTS

| | | | |
|---|---|---|---|
| 7,216,461 | B1 | 5/2007 | Clemmer |
| 7,263,811 | B1 | 9/2007 | Clemmer |
| 7,278,176 | B2 | 10/2007 | Clarke |
| 8,418,281 | B2 | 4/2013 | Sutter |
| 9,689,152 | B2 | 6/2017 | Hocaoglu |
| 9,803,347 | B2 | 10/2017 | Hocaoglu |
| 10,221,552 | B2 | 3/2019 | Hocaoglu |
| 10,370,835 | B2 | 8/2019 | Hocaoglu et al. |
| 2008/0178381 | A1 | 7/2008 | Montgomery et al. |
| 2009/0144893 | A1 | 6/2009 | Cusimano |
| 2010/0017956 | A1 | 1/2010 | Chen |
| 2012/0306165 | A1 | 12/2012 | Sutter |
| 2014/0250589 | A1 | 9/2014 | Sgarlata et al. |
| 2015/0059082 | A1 | 3/2015 | Hocaoglu |
| 2015/0059083 | A1 | 3/2015 | Hocaoglu |
| 2015/0059084 | A1 | 3/2015 | Hocaoglu |
| 2015/0354188 | A1 | 12/2015 | Hocaoglu |

FOREIGN PATENT DOCUMENTS

| | | |
|---|---|---|
| CA | 2506806 | 10/2006 |
| CA | 2839586 | 1/2014 |
| CN | 2600497 | 1/2004 |
| CN | 2837401 | 11/2006 |
| CN | 104452917 | 3/2015 |
| DE | 10254052 | 7/2004 |
| EP | 1422352 | 5/2004 |
| EP | 2884013 | 3/2014 |
| FR | 2757031 | 6/1998 |
| FR | 2792345 | 10/2000 |
| WO | WO2009073873 | 6/2009 |

FARMHOUSE SINK SYSTEM WITH A RIMLESS METALLIC SINK AND METHOD OF FORMING THE SAME

FIELD OF THE INVENTION

The present invention is directed to a farmhouse style sink system incorporating a rimless metallic sink that is significantly more durable and hygienic as compared to traditional farmhouse sink systems.

BACKGROUND OF THE INVENTION

Farmhouse sink systems include a farmhouse sink frame having a sink basin incorporated therein, wherein the farmhouse sink frame is typically mounted below a countertop, flush with the top of an underlying cabinet or cabinets, thereby providing the unique "farmhouse" look and feel. Traditionally, farmhouse sink systems are formed from any number of materials of construction including, but not limited to, fireclay, cast iron, porcelain, quartz, granite, or marble, just to name a few. As is well known in the art, over time, the materials typically used to construct farmhouse sink systems are susceptible to chipping, cracking, etc. Furthermore, a number of these materials are notorious for being difficult to thoroughly clean due to the somewhat irregular surface condition on the inside of the farmhouse sink basin.

In a typical installation of a farmhouse sink system, an opening is created in a cabinet or cabinets which is dimensioned to receive a farmhouse sink frame therein. The supporting framework is secured to portions of the cabinet or cabinets adjacent to the opening created to receive the farmhouse sink frame. The supporting framework is positioned such that the top surface of the farmhouse sink frame is in line and level with the top surface of the cabinet or cabinets. It is also typical for a farmhouse sink frame to include an apron which extends outwardly from the front face of the cabinet or cabinets.

Next, and access opening corresponding generally to the dimensions of the farmhouse sink basin is created through a portion of a countertop. Silicone sealant is applied between the interface along the lower surface of the countertop and the top surface of the farmhouse sink frame. The silicone sealant is typically fully cured in about 24 hours, after which time a faucet, drain, and any other plumbing appurtenances are installed to the farmhouse sink frame, and a typical farmhouse sink system is ready for use.

As noted above, the materials typically used to construct farmhouse sink systems are susceptible to chipping, cracking, etc., and a number of these materials are difficult to thoroughly clean due to the somewhat irregular surface condition on the inside of the farmhouse sink basin. As such, it would be highly beneficial to provide a farmhouse sink system which combines the highly desired aesthetic appeal of the "farmhouse" sink style with a stainless-steel sink basin for substantially improved durability and hygiene. A further advantage may be realized by providing an improved farmhouse sink system having a farmhouse sink frame which is constructed of a lightweight and durable material.

It would also be extremely beneficial to provide a system to retrofit an existing farmhouse sink system with a rimless metallic, e.g., stainless steel or copper, sink basin to overlie and conceal a damaged original farmhouse sink basin, thereby substantially improving durability and hygiene of the existing farmhouse sink system. It would also be advantageous to provide a new farmhouse sink system having typical materials of construction, such as, but not limited to, fireclay, cast iron, porcelain, quartz, granite or marble, which further comprises a rimless metallic sink basin, once again, to substantially improve durability and hygiene of the new farmhouse sink system.

Those known farmhouse sink systems also fail to combine the classic beauty of the farmhouse kitchen sinks with a more modern, easy to maintain, and more structurally stable metallic washbasin.

Therefore, a need exists to overcome the problems with the prior art as discussed above.

SUMMARY OF THE INVENTION

The invention provides a farmhouse sink system with a rimless metallic sink that overcomes the herein fore-mentioned disadvantages of the heretofore-known devices and methods of this general type and that includes a recessed mounting flange that rests on a substantially rigid, e.g., stainless steel, frame which sits on stone footings. A stone box is then dropped on to the sink structure and adhered on with acrylic liquid bonding agents. The rimless edge of the stainless-steel sink is preferably not flush with the stone box top surface, but rather it is recessed under a lip around stone box.

With the foregoing and other objects in view, there is provided, in accordance with the invention, a farmhouse sink system with a rimless metallic sink having a cabinet assembly with a lower support surface, a countertop having an upper surface, a lower surface coupled to the cabinet assembly, and defining a sink access opening therethrough and spanning to the lower support surface of the cabinet assembly. Further, the invention includes a farmhouse sink frame having a sidewall with a top surface at least partially superimposed by and mounted below the lower surface of the countertop, with a lower surface opposing the top surface of the sidewall of the farmhouse sink frame, defining a sink frame access opening therethrough, and an upper lip extending laterally inward toward the sink frame access opening on at least two opposing sides of the sidewall of the farmhouse sink frame. The assembly also includes a metallic sink disposed within the sink frame access opening, having a sidewall coupled to a bottom wall to define, with an inner sidewall surface of the sidewall of the metallic sink, at least one bowl. The metallic sink includes a mounting flange member laterally extending outwardly from an outer sidewall surface of the sidewall of the metallic sink, and having a rimless upper edge disposed along and around the sidewall of the metallic sink and superimposed by the upper lip of the farmhouse sink frame. A sink mounting frame assembly may be utilized that includes a metallic lower horizontally oriented frame member disposed proximal to the lower support surface of the cabinet assembly and a longitudinally oriented metallic frame member separating and vertically displacing, with respect to the lower horizontally oriented frame member, an upper horizontally oriented metallic frame member directly coupled to the mounting flange member.

In accordance with a further feature of the present invention, the upper horizontally oriented metallic frame member is coupled to the sidewall and upper lip of the farmhouse sink frame through an adhesive bonding layer, thereby forming a unitary structure.

In accordance with yet another feature of the present invention, the adhesive bonding layer surrounds at least a portion of the upper horizontally oriented metallic frame member and the mounting flange member. The adhesive bonding layer may also be directly coupled to a lower surface of the upper lip and is of thickness of approximately 1-2 inches.

In accordance with another feature, an embodiment of the present invention includes the upper lip having an inner periphery surface at least partially defining the sink access opening, wherein the upper lip defines a lip channel spanning inwardly into the upper lip from the inner periphery surface and haves the rimless upper edge disposed therein.

In accordance with a further feature of the present invention, the mounting flange member extends continuously around a circumference of the outer sidewall surface of the sidewall of the metallic sink.

In accordance with another feature of the present invention, the upper horizontally oriented metallic frame member encloses and defines an upper frame aperture with the metallic sink disposed therein and with the mounting flange member seated around a perimeter of the upper horizontally oriented metallic frame member.

In accordance with an additional feature of the present invention, the mounting flange member is recessed uniformly below the rimless upper edge.

In accordance with a further feature of the present invention, the lower support surface of the cabinet assembly supports at least 90% of an overall weight defined by the farmhouse sink frame, metallic sink, and metallic sink mounting frame assembly.

In accordance with an additional feature, an embodiment of the present invention also includes a plurality of support footings directly coupled to the lower horizontally oriented frame member and directly coupled to the lower support surface of the cabinet assembly.

In accordance with yet another feature of the present invention, the plurality of support footings are of a substantially rigid material and selectively translatably coupled to the lower horizontally oriented frame member.

In accordance with an exemplary feature of the present invention, the upper lip is disposed at an upper terminal edge of the sidewall of the farmhouse sink frame and includes the top surface of the sidewall of the farmhouse sink frame that continuously surrounds an upper periphery of the farmhouse sink frame.

In accordance with a further feature of the present invention, the sidewall encloses the bottom wall defining the at least one bowl. Additionally, the metallic sink may be either of a stainless steel or copper material.

Also in accordance with the present invention, a farmhouse sink system with a rimless metallic sink is disclosed that includes a farmhouse sink frame having a sidewall with a top surface for mounting underneath a lower surface of a countertop, with a lower surface opposing the top surface of the sidewall of the farmhouse sink frame, defining a sink frame access opening therethrough, and an upper lip extending laterally inward toward the sink frame access opening on at least two opposing sides, of the sidewall of the farmhouse sink frame. The assembly may also include a metallic sink disposed within the sink frame access opening, having a sidewall coupled to a bottom wall to define and enclose, with an inner sidewall surface of the sidewall of the metallic sink, at least one bowl, having a mounting flange member laterally extending outwardly from an outer sidewall surface of the sidewall of the metallic sink, and having a rimless upper edge disposed along and around the sidewall of the metallic sink and superimposed by the upper lip of the farmhouse sink frame. The assembly may also include a sink mounting frame assembly with a metallic lower horizontally oriented frame member and a longitudinally oriented metallic frame member separating and vertically displacing, with respect to the lower horizontally oriented frame member, an upper horizontally oriented metallic frame member directly coupled to the mounting flange member, wherein the upper horizontally oriented metallic frame member is coupled to the sidewall and upper lip of the farmhouse sink frame through an adhesive bonding layer, thereby forming a unitary structure.

Also in accordance with the present invention, a method of forming a farmhouse sink system with a rimless metallic sink is disclosed that includes the steps of placing a top surface of a sidewall of a farmhouse sink frame adjacent to a support surface, the farmhouse sink frame having a lower surface opposing the top surface of the sidewall of the farmhouse sink frame and vertically displaced a length from the support surface, defining a sink frame access opening therethrough, and an upper lip extending laterally inward toward the sink frame access opening on at least two opposing sides of the sidewall of the farmhouse sink frame, the upper lip having a lower surface. Next, a user may insert the rimless upper edge of a sidewall of a metallic sink, rimless upper edge first, into the sink frame access opening until reaching the lower surface of the upper lip to define a periphery channel, wherein the sidewall of the metallic sink is coupled to a bottom wall to define and enclose, with an inner sidewall surface of the sidewall of the metallic sink, at least one bowl, and have a mounting flange member laterally extending outwardly from an outer sidewall surface of the sidewall of the metallic sink, wherein the rimless upper edge is disposed along and around the sidewall of the metallic sink. The process may also include inserting an upper horizontally oriented metallic frame member of a sink mounting frame assembly, upper horizontally oriented metallic frame member first, into the sink frame access opening until reaching a lower surface of the mounting flange member and to surround the outer surface of the metallic sink, wherein the sink mounting frame assembly has a metallic lower horizontally oriented frame member and a longitudinally oriented metallic frame member separating and vertically displacing, with respect to the lower horizontally oriented frame member. The upper horizontally oriented metallic frame member and/or the sink mounting frame assembly may have a plurality of support footings each directly coupled to the lower horizontally oriented frame member and each having a terminal end surface defining a support plane disposed and opposing the top surface of a sidewall of a farmhouse sink frame. Next, process would include inserting a malleable adhesive material into the periphery channel and around the outer sidewall surface of the sidewall of the metallic sink and an inner surface of the sidewall of the farmhouse sink frame and then allowing the malleable adhesive material to cure, harden, and form an adhesive bonding layer coupling the upper horizontally oriented metallic frame member and the sidewall and upper lip of the farmhouse sink frame, thereby forming a unitary structure.

Although the invention is illustrated and described herein as embodied in a farmhouse sink system and method of forming the same, it is, nevertheless, not intended to be limited to the details shown because various modifications and structural changes may be made therein without departing from the spirit of the invention and within the scope and range of equivalents of the claims. Additionally, well-known elements of exemplary embodiments of the invention will not be described in detail or will be omitted so as not to obscure the relevant details of the invention.

Other features that are considered as characteristic for the invention are set forth in the appended claims. As required, detailed embodiments of the present invention are disclosed herein; however, it is to be understood that the disclosed embodiments are merely exemplary of the invention, which can be embodied in various forms. Therefore, specific structural and functional details disclosed herein are not to be interpreted as limiting, but merely as a basis for the claims and as a representative basis for teaching one of ordinary skill in the art to variously employ the present invention in virtually any appropriately detailed structure. Further, the terms and phrases used herein are not intended to be limiting; but rather, to provide an understandable description of the invention. While the specification concludes with claims defining the features of the invention that are regarded as novel, it is believed that the invention will be better understood from a consideration of the following description in conjunction with the drawing figures, in which like reference numerals are carried forward. The figures of the drawings are not drawn to scale.

Before the present invention is disclosed and described, it is to be understood that the terminology used herein is for the purpose of describing particular embodiments only and is not intended to be limiting. The terms "a" or "an," as used herein, are defined as one or more than one. The term "plurality," as used herein, is defined as two or more than two. The term "another," as used herein, is defined as at least a second or more. The terms "including" and/or "having," as used herein, are defined as comprising (i.e., open language). The term "coupled," as used herein, is defined as connected, although not necessarily directly, and not necessarily mechanically. The term "providing" is defined herein in its broadest sense, e.g., bringing/coming into physical existence, making available, and/or supplying to someone or something, in whole or in multiple parts at once or over a period of time. Also, for purposes of description herein, the terms "upper", "lower", "left," "rear," "right," "front," "vertical," "horizontal," and derivatives thereof relate to the invention as oriented in the figures and is not to be construed as limiting any feature to be a particular orientation, as said orientation may be changed based on the user's perspective of the device. Furthermore, there is no intention to be bound by any expressed or implied theory presented in the preceding technical field, background, brief summary or the following detailed description.

As used herein, the terms "about" or "approximately" apply to all numeric values, whether or not explicitly indicated. These terms generally refer to a range of numbers that one of skill in the art would consider equivalent to the recited values (i.e., having the same function or result). In many instances these terms may include numbers that are rounded to the nearest significant figure. In this document, the term "longitudinal" should be understood to mean in a direction corresponding to an elongated direction of the farm farmhouse sink system spanning from a top surface of the sidewall of the farmhouse sink frame to the lower surface of the sidewall of the farmhouse sink frame.

BRIEF DESCRIPTION OF THE DRAWINGS

The accompanying figures, where like reference numerals refer to identical or functionally similar elements throughout the separate views and which together with the detailed description below are incorporated in and form part of the specification, serve to further illustrate various embodiments and explain various principles and advantages all in accordance with the present invention.

DETAILED DESCRIPTION

Figure 1:
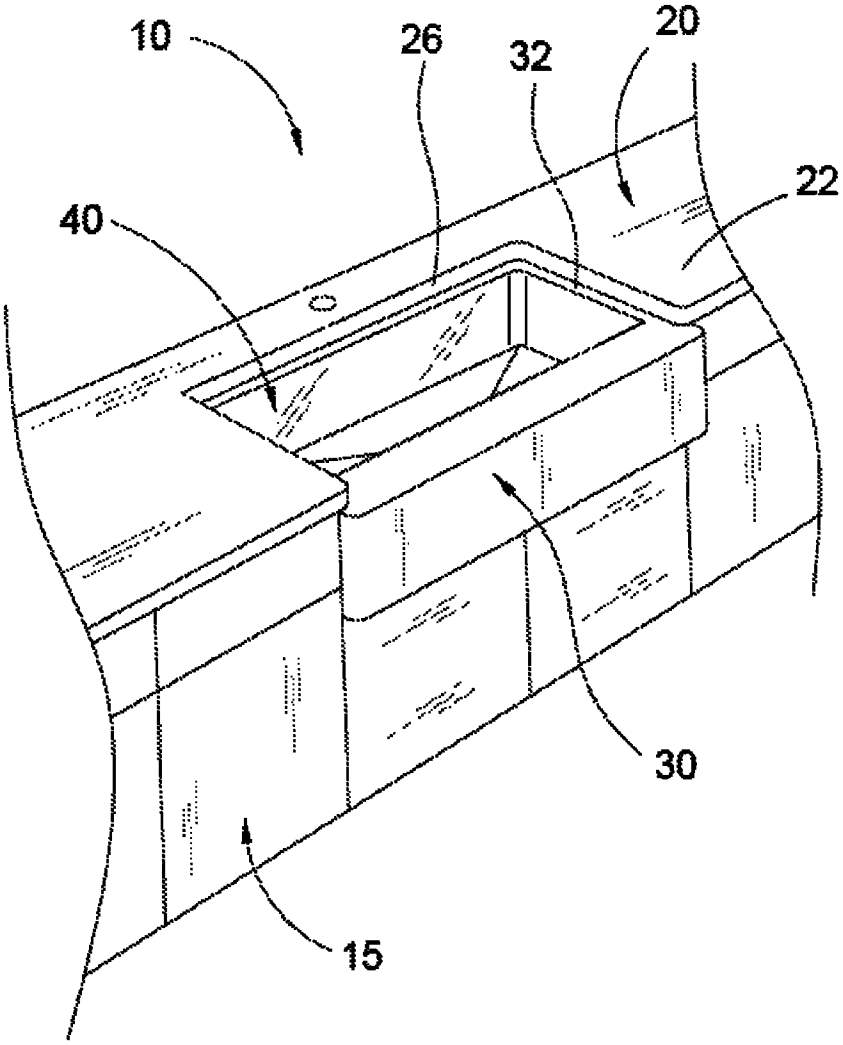
FIG. 1 is a perspective view of one illustrative embodiment of a farmhouse sink system with a rimless stainless-steel sink in accordance with the present invention.

While the specification concludes with claims defining the features of the invention that are regarded as novel, it is believed that the invention will be better understood from a consideration of the following description in conjunction with the drawing figures, in which like reference numerals are carried forward. It is to be understood that the disclosed embodiments are merely exemplary of the invention, which can be embodied in various forms.

The present invention is directed to a farmhouse sink system with a rimless stainless-steel sink generally as shown as at 10 throughout the figures. With reference to the illustrative embodiment of FIG. 1, a farmhouse sink system with a stainless-steel sink 10 includes a cabinet assembly 15 and a countertop 20. As further shown in the illustrative embodiment of FIG. 1, a farmhouse sink system with the stainless-steel sink 10 further includes a farmhouse sink frame 30 having a stainless-steel sink 40 seamlessly installed therein. With continued reference to the illustrative embodiment of FIG. 1, the farmhouse sink frame 30 is operatively disposed between the cabinet assembly 15 and a sink access opening 26 through the countertop 20 and below an upper surface 22 thereof, in accordance with known installation methods as discussed above with regard to the related art.

Figure 2:
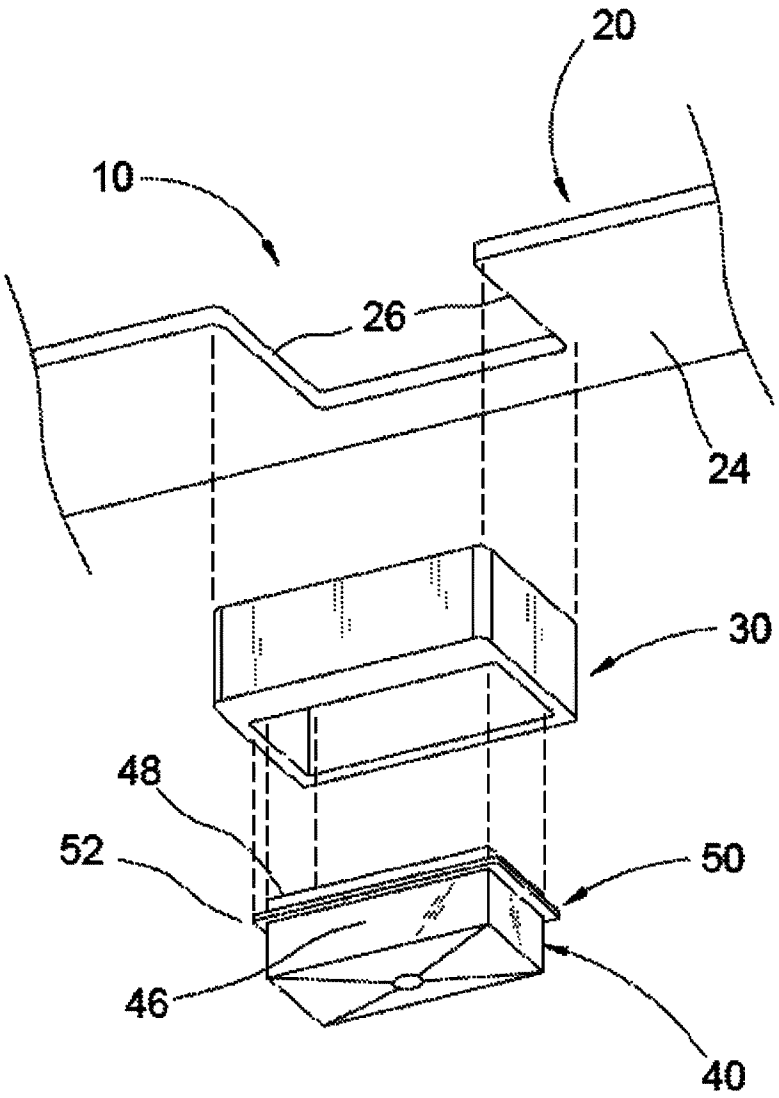
FIG. 2 is a partial exploded perspective view of another illustrative embodiment of a farmhouse sink system with a rimless stainless-steel sink in accordance with the present invention.

FIG. 2 is an exploded perspective view of another illustrative embodiment of a farmhouse sink system with the stainless-steel sink 10 in accordance with the present invention. As may be seen from FIG. 2, countertop 20 has a sink access opening 26 formed there through. In at least one embodiment, a sink access opening 26 comprises a generally U-shaped configuration. As will be appreciated by those of skill in the art, a sink access opening 26 may be dimensioned so as to align with an outer periphery 49 of a bowl 42 of a stainless-steel sink 40. Alternatively, a sink access opening 26 may be dimensioned slightly larger than an outer periphery 49 of a bowl 42 of a stainless steel sink 40 such that a portion of a top surface 32 of a farmhouse sink frame 30 is exposed and forms a lip or ledge around the outer periphery 49 of the bowl 42 of the stainless steel sink 40, such as is shown in the illustrative embodiment of FIG. 1.

Looking once again to the illustrative embodiment of FIG. 2, the farmhouse sink system with a rimless stainless-steel sink 10 further comprises a farmhouse sink frame 30. As shown in the exploded perspective view of FIG. 2, the farmhouse sink frame 30 is affixed to a lower surface 24 of the countertop 20 proximate to a sink access opening 26. As will be appreciated by those of skill in the art, a farmhouse sink frame 30 in accordance with the present invention may be formed from any number of materials of construction including, but not limited to, fireclay, cast iron, porcelain, quartz, granite or marble, just to name a few. In at least one embodiment, a farmhouse sink frame 30 in accordance with the present invention is formed of acrylic. The interface between the lower surface 22 of the countertop 20 and the top surface 32 of the farmhouse sink frame 30 may be sealed with any appropriate water-resistant sealant such as, by way of example only, silicone.

As further shown in the illustrative embodiment of FIG. 2, a stainless-steel sink 40 is under mounted into a farmhouse sink frame 30. A mounting assembly 50 comprising at least one mounting bracket 52 is affixed to the sidewall 46 of the stainless-steel sink 40 below a rimless upper edge 48 thereof. The at least one mounting bracket 52 is utilized to under mount the stainless-steel sink 40 to the farmhouse sink frame 30.

Figure 3A:
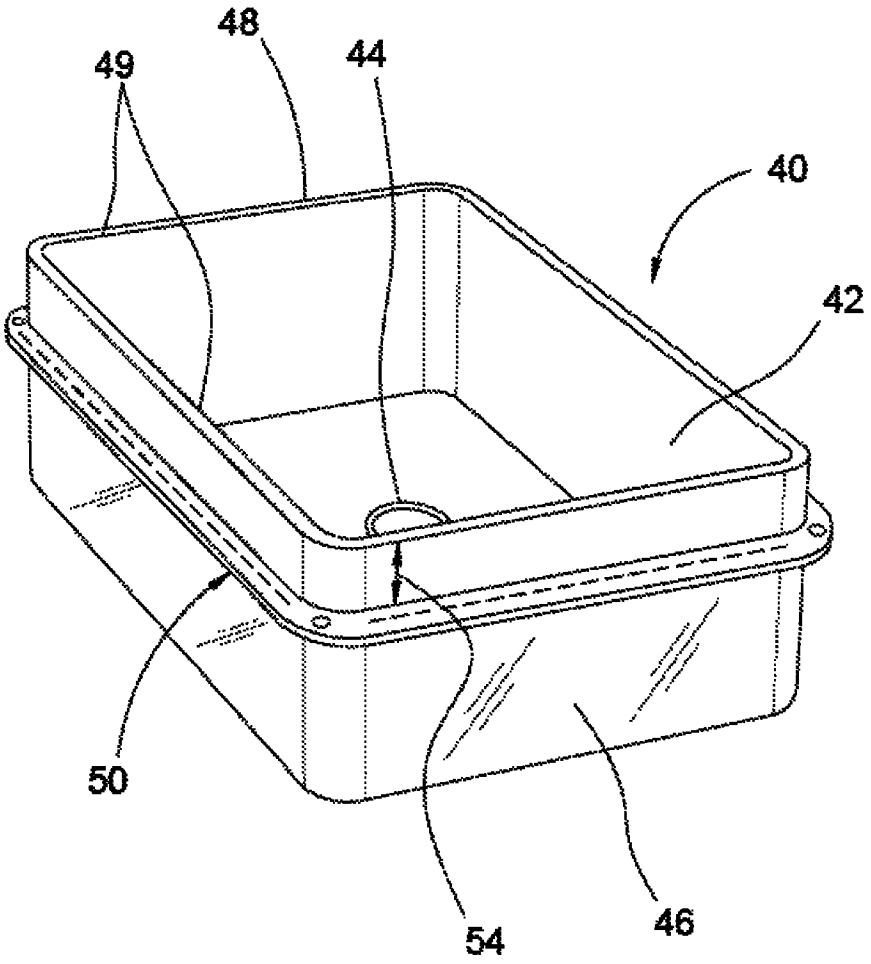
FIG. 3A is a perspective view of one illustrative embodiment of a stainless-steel sink in accordance with the present invention.
Figure 3B:
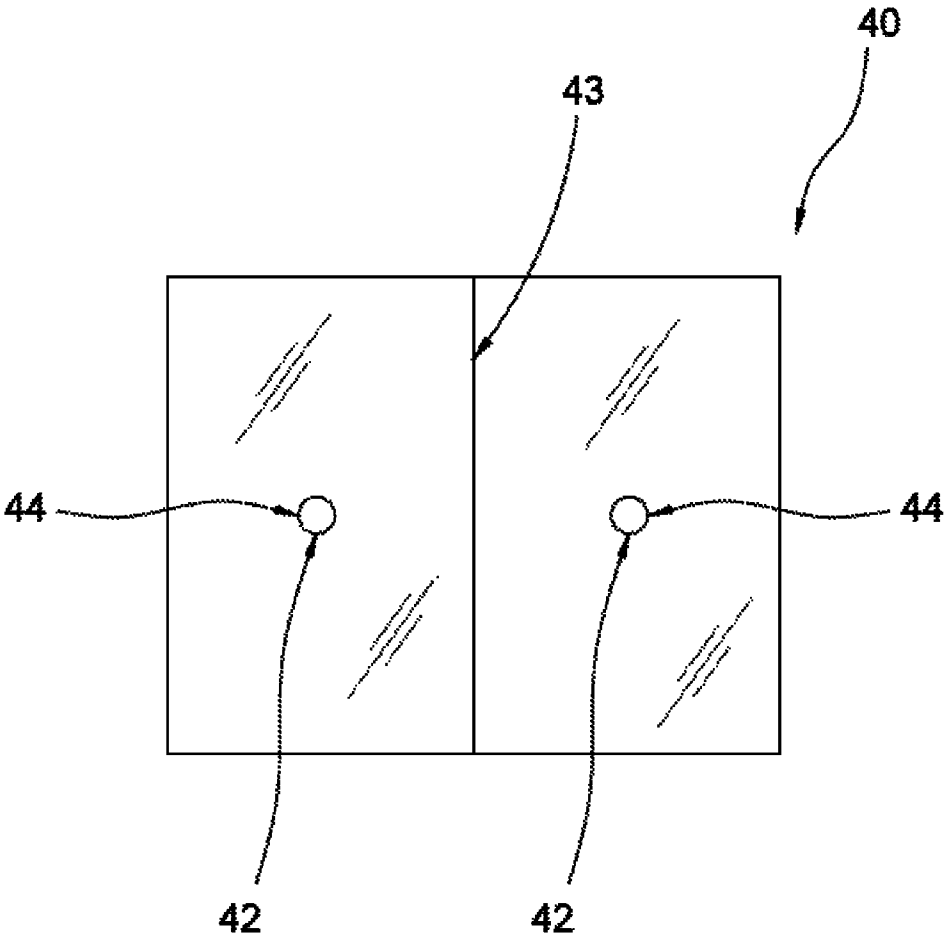
FIG. 3B is a top view of one illustrative embodiment of a stainless-steel sink in accordance with the present invention.

Turning next to FIG. 3A, a perspective view of one illustrative embodiment of a stainless-steel sink 40 in accordance with the present invention is shown. A stainless-steel sink 40 includes at least one bowl 42 having a drain 44 disposed through a lower surface thereof. As will be appreciated by those of skill in the art, and as illustrated in FIG. 3B, a stainless-steel sink 40 could comprise a plurality of bowls 42 separated from one another via a recessed divider 43, each bowl 42 having a corresponding drain 44. Looking further to the illustrative embodiment of FIG. 3A, the stainless-steel sink 40 comprises a sidewall 46 at least partially defining the configuration of the bowl 42. The sidewall 46 of the stainless-steel sink 40 has a rimless upper edge 48 disposed there around, the rimless upper edge 48 defining an outer periphery 49 of the stainless-steel sink 40.

With continued reference to the illustrative embodiment of FIG. 3A, a mounting assembly 50 is affixed to a portion of the stainless steel sink 40 to facilitate mounting the stainless steel sink 40 into the farmhouse sink frame 30, as described in further detail below. A mounting assembly 50 in accordance with the present invention comprises at least one mounting bracket 52 affixed to a portion of the sidewall 46 of the stainless-steel sink 40. As shown in the illustrative embodiment of FIG. 3A, the mounting assembly 50 comprises a single continuous mounting bracket 52 extending around the entire sidewall 46 of the stainless-steel sink 40. As will be appreciated by those of skill in the art, a plurality of mounting brackets 52 independent of one another may be affixed to different portions of the sidewall 46 of the stainless steel sink 40, in lieu of the single continuous mounting bracket 52 as shown throughout the figures. As further shown in the illustrative embodiment of FIG. 3A, a mounting bracket 52 is affixed to the sidewall 46 of the stainless-steel sink 40 at a predetermined mounting depth 54 below the rimless upper edge 48 of the stainless steel sink 40. More in particular, a predetermined mounting depth 54 shall be equal to the thickness of a sink mounting aperture 36 formed between a top surface and an interior bottom surface 34 of a farmhouse sink frame 30 as discussed in further detail below. In at least one embodiment, a predetermined mounting depth 54 has a tolerance of between 0.0 and −1.0 millimeters.

Figure 4:
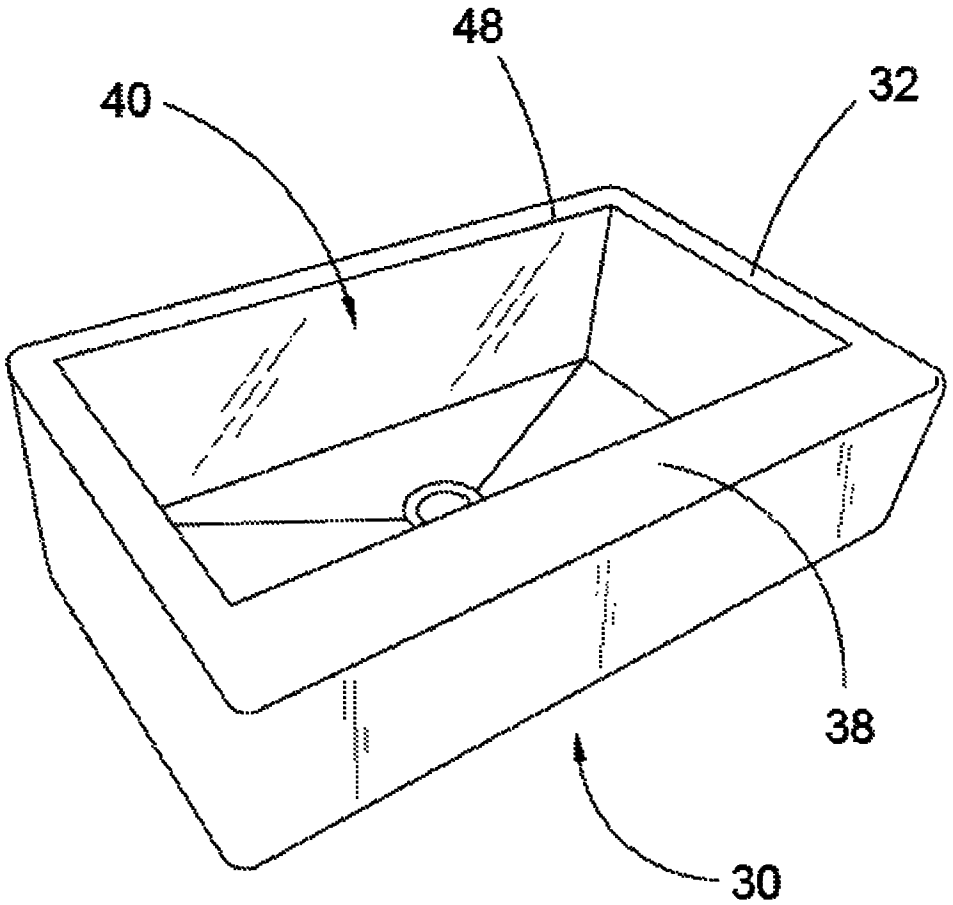
FIG. 4 is a top perspective view of one illustrative embodiment of a stainless-steel sink seamlessly mounted in a farmhouse sink frame in accordance with the present invention.

Turning next to FIGS. 4-7, one illustrative embodiment of a farmhouse sink frame 30 having a stainless-steel sink 40 seamlessly installed therein is presented. More in particular, FIG. 4 is illustrative of one embodiment of a stainless-steel sink 40 seamlessly installed in a farmhouse sink frame 30. As may be seen from FIG. 4 and FIG. 7, a rimless upper edge 48 of the stainless-steel sink 40 is essentially coplanar with a top surface 32 of the farmhouse sink frame 30. FIG. 4 further illustrates a farmhouse sink frame 30 having an apron 38 extending outwardly from the stainless-steel sink 40 along the front of the farmhouse sink frame 30.

Figure 5:
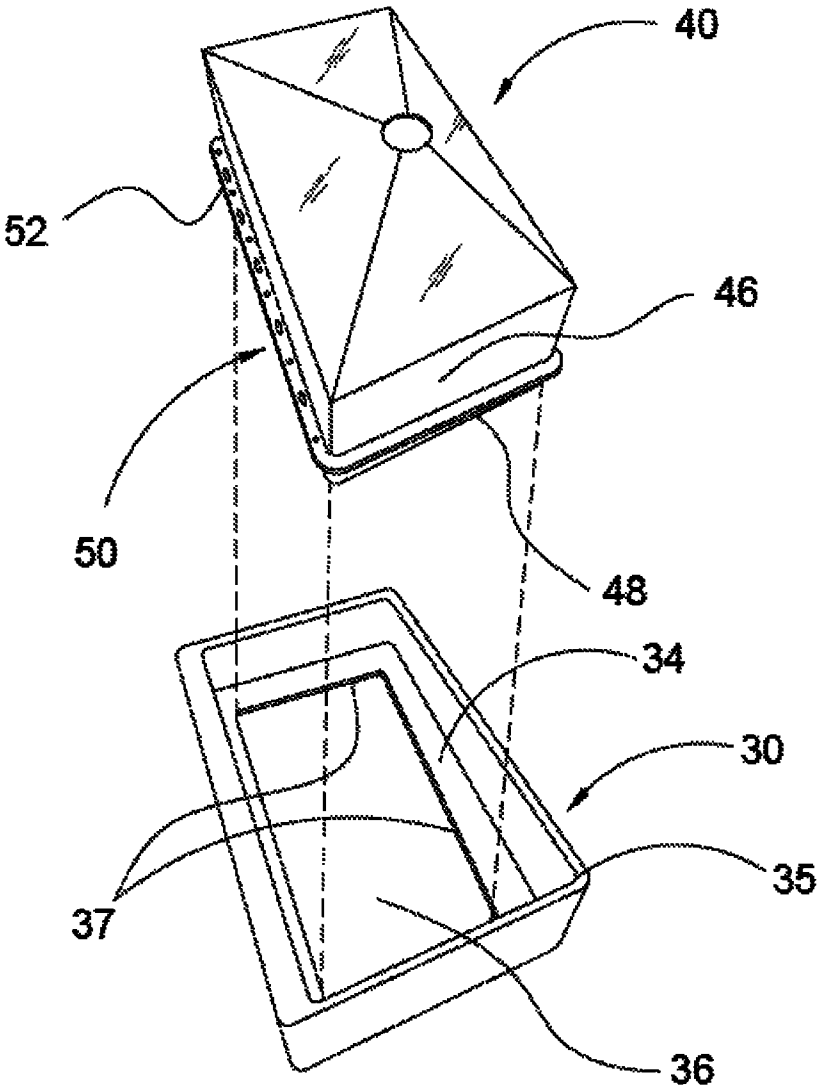
FIG. 5 is an exploded bottom perspective view of the stainless-steel sink and the farmhouse sink frame of FIG. 4.
Figure 6:
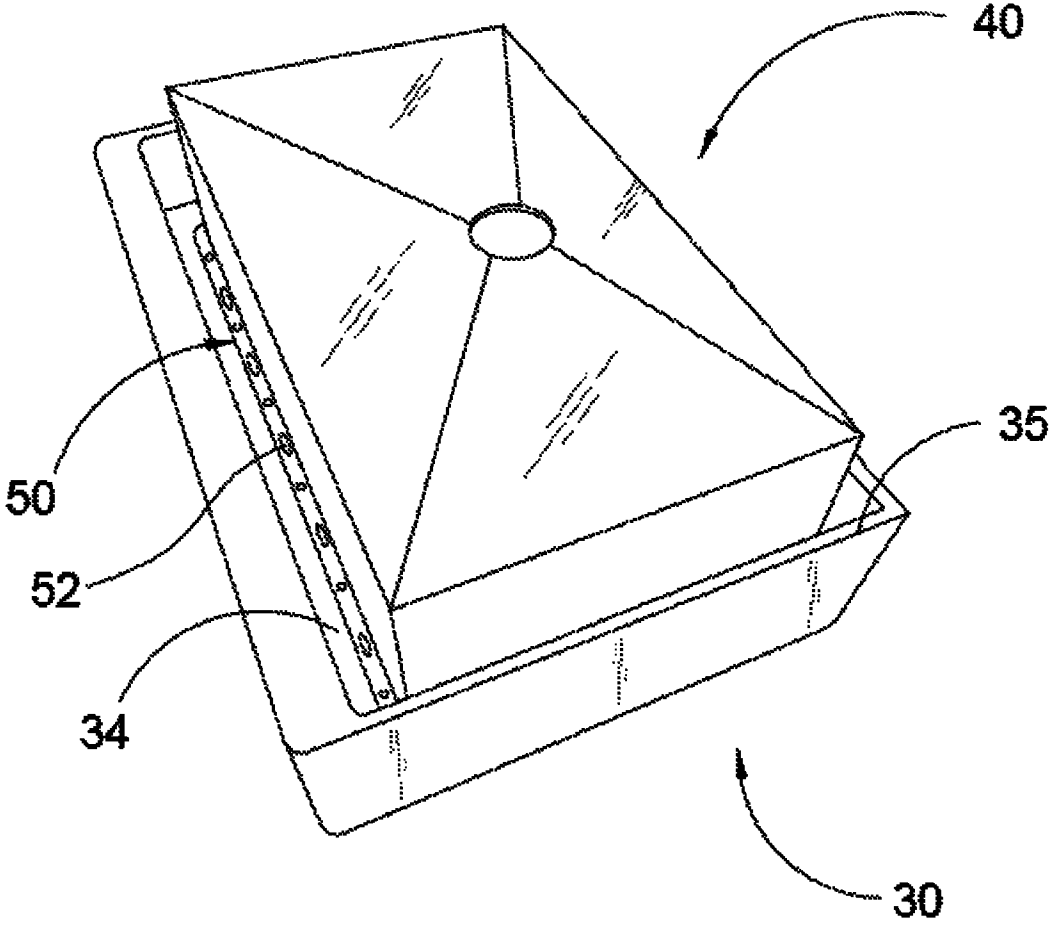
FIG. 6 is a bottom perspective view of the stainless-steel sink mounted in the farmhouse sink frame of FIG. 5.

FIG. 5 is an exploded bottom perspective view of a stainless-steel sink 40 and a farmhouse sink frame 30 in accordance with at least one embodiment of the present invention. As an initial matter, as may be seen from the illustrative embodiment of FIG. 5, a farmhouse sink frame 30 in accordance with at least one embodiment of the present invention comprises a recessed interior bottom surface 34 and an exterior bottom surface 35. A sink mounting aperture 36 is formed through the interior bottom surface 34 of the farmhouse sink frame 30. More in particular, a sink mounting aperture 36 comprises an inner periphery 37 which is dimensioned to correspond to the outer periphery 49 along the rimless upper edge 48 of the sidewall 46 of the stainless-steel sink 40. In at least one embodiment, the tolerance between an inner periphery 37 of a sink mounting aperture 36 of a farmhouse sink frame 30 and an outer periphery 49 along a rimless upper edge 48 of the stainless steel sink 40 is less than 1.0 millimeter.

As further illustrated in FIG. 5, a mounting assembly 50 comprises a continuous mounting bracket 52 is affixed around and encircling the entire sidewall 46 of the stainless-steel sink 40. Turning next to the illustrative embodiment of FIG. 6, the mounting bracket 52 abuts against the interior bottom surface 34 of the farmhouse sink frame 30.

Figure 7:
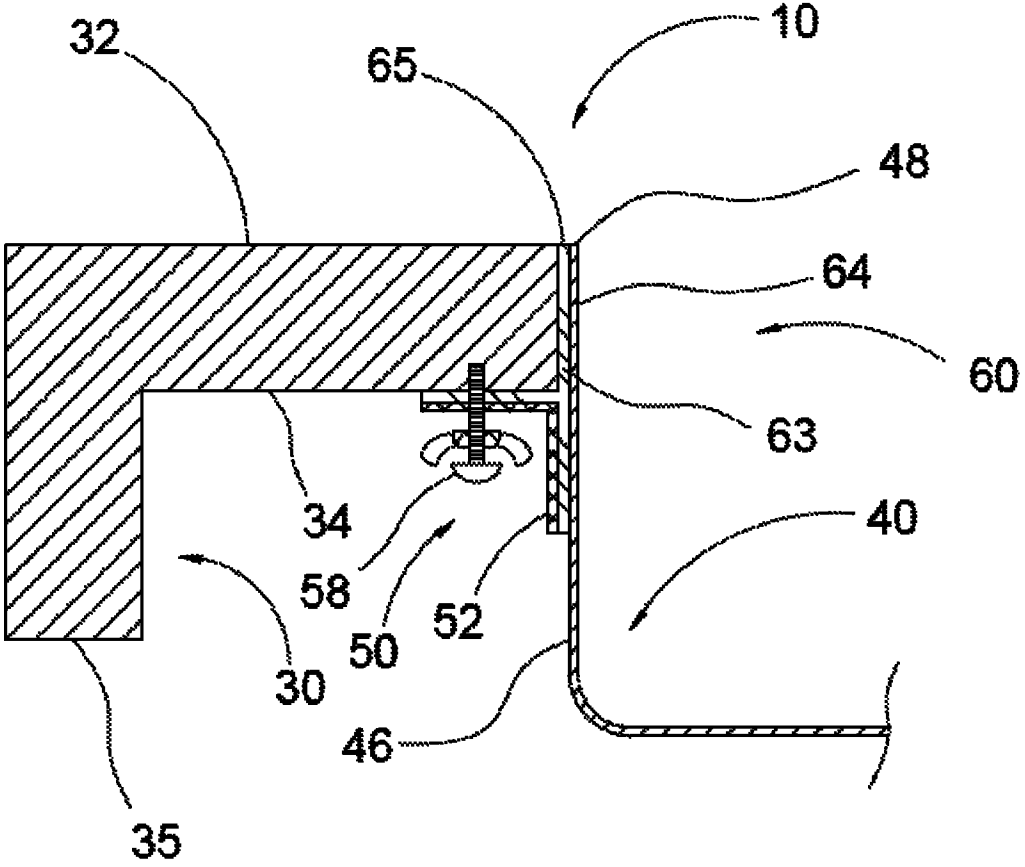
FIG. 7 is a partial cross-sectional view of one illustrative embodiment of a stainless-steel sink mounted in a farmhouse sink frame in accordance with the present invention.

FIG. 7 is a partial cross-sectional view of one illustrative embodiment of a stainless-steel sink 40 mounted in a farmhouse sink frame 30 in accordance with the present invention. As may be seen from FIG. 7, a portion of a mounting assembly 50, i.e., a mounting bracket 52, is securely attached to a portion of a sidewall 46 of a stainless-steel sink 40. It will be appreciated by those of skill in the art that a mounting bracket 52 may be securely attached to a sidewall 46 of a stainless steel sink 40 by any of a variety of means including but not limited to welding, adhesives, such as, by way of example only, an acrylic resin, an epoxy resin or a polyester resin, or via mechanical fasteners such as screws, bolts, rivets, etc. It will further be appreciated that a combination of means may be employed in order to further assure that a mounting bracket 52 is securely attached along and around a sidewall 46 of a stainless-steel sink 40. As will be further appreciated by those of skill in the art, a mounting bracket 52 may be securely attached to a sidewall 46 of a stainless steel sink 40 prior to delivery to an installation site, however, alternatively, one or more mounting bracket 52 may be securely attached to a sidewall 46 of a stainless steel sink 40 at the installation site during installation of the present farmhouse sink system with a rimless stainless steel sink 10.

With further reference to the illustrative embodiment of FIG. 7, a portion of a mounting bracket 52 is securely attached to a portion of the interior bottom surface 34 of the farmhouse sink frame 30. As before, any of a variety of appropriate attachment means may be utilized to securely attach a portion of a mounting bracket 52 to the interior bottom surface 34 of the farmhouse sink frame 30, such as an adhesive including, by way of example only, an acrylic resin, an epoxy resin or a two-part epoxy resin. In such an embodiment, the adhesive is permitted to flow through the apertures through the mounting bracket 52 and onto the underside of a portion of the mounting bracket 52 to further facilitate securely attaching the mounting bracket 52 to the interior bottom surface 34 of the farmhouse sink frame 30. In at least one other embodiment, a mechanical fastener 58, such as a screw or bolt, is utilized in order to securely attach a portion of a mounting bracket 52 to the interior bottom surface 34 of the farmhouse sink frame 30. In at least one embodiment, a mounting clip (not shown) may be utilized in combination with a mechanical fastener 58. As will be appreciated by those of skill in the art, a combination of an adhesive and a mechanical fastener 58 may be utilized in order to further assure that a mounting bracket 52 is securely attached to the interior bottom surface 34 of the farmhouse sink frame 30.

Looking again to the illustrative embodiment of FIG. 7, a farmhouse sink system with a rimless stainless-steel sink 10 in accordance with the present invention further comprises a sealing assembly 60. The sealing assembly 60 includes an upper seal 64 which is applied along and around the upper interface 62 between the inner periphery 37 of sink mounting aperture 36 of the farmhouse sink frame 30 and the outer periphery 49 around and along the rimless upper edge 48 of the sidewall 46 of the stainless steel sink 40. In one embodiment, the upper seal 64 comprises an adhesive, such as, by way of example only, an acrylic resin, an epoxy resin or an epoxy glue which is securely bonded to both the farmhouse sink frame 30 and the stainless steel sink 40, thereby providing an essentially impervious seal over and along the upper interface 62. In an alternate embodiment, the upper seal 64 comprises a polyester resin to securely bond to both the farmhouse sink frame 30 and the stainless-steel sink 40, once again, providing an essentially impervious seal over and along the upper interface 62. In further embodiments, the upper seal 64 comprises an adhesive such as, by way of example, an acrylic casting resin, a polyester resin, a polyurethane resin, an epoxy resin or an epoxy glue, or combinations thereof. As will be appreciated, the upper seal 64 will serve to prevent water, moisture, bacteria, food, and/or other debris such as may be encountered in a sink environment from entering into the area between the farmhouse sink frame 30 and the stainless steel sink 40, in particular, into and through the upper interface 62 there between. In at least one embodiment, an upper seal 64 may be sanded or ground down as needed to remove any rough edges or overspills so as to assure a seamless interface between the inner periphery 37 of the sink mounting aperture 36 of the farmhouse sink frame 30 and the outer periphery 49 around and along the rimless upper edge 48 of the sidewall 46 of the stainless steel sink 40.

In at least one further embodiment, a top coat 65 is applied to the upper seal 64 wherein the top coat 65 is selected based on the color of the top surface 32 of the farmhouse sink frame 30 so as to camouflage the presence of the upper seal 64. The top coat 65, in at least one embodiment, comprises a color matching acrylic, epoxy or polyester resin selected to simulate the color of the top surface 32 of the farmhouse sink frame 30. In yet one further embodiment, the upper seal 64 and/or top coat 65 may be further finished by sanding, buffing, etc., so as to further camouflage the presence of the upper seal 64, thereby enhancing the overall seamless appearance between the stainless steel sink 30 and the farmhouse sink frame 30 along the upper seal 64, such as is shown best in FIG. 1.

Figure 8:
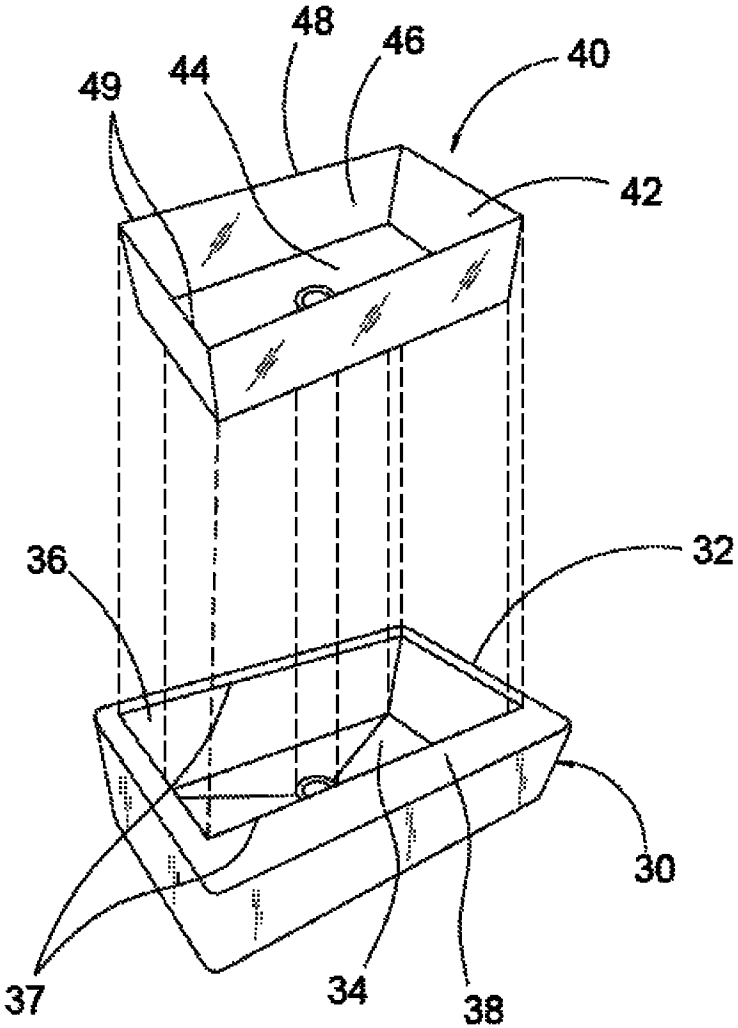
FIG. 8 is an exploded perspective view of one alternative illustrative embodiment of a farmhouse sink system with a rimless stainless-steel sink in accordance with the present invention.

FIG. 8 is an exploded perspective view of one alternative illustrative embodiment of a farmhouse sink frame 30 with a rimless stainless-steel sink 40 in accordance with the present invention. Unlike the illustrative embodiments of the present invention as shown in the preceding figures, the embodiment of FIG. 8 comprises a top mounted rimless stainless-steel sink 40. As before, the stainless-steel sink 40 comprises a sidewall 46 at least partially defining a bowl 42, wherein the bowl has a drain 44 disposed along a lower portion thereof. Also as before, the stainless-steel sink 40 has a rimless upper edge 48 which at least partially defines an outer periphery 49 around the sidewall 46 of the stainless-steel sink 40.

Turning next to the farmhouse sink frame 30 of the illustrative embodiment of FIG. 8, as before, the farmhouse sink frame 30 has a top surface 32 and, in at least one embodiment, an apron 38. The farmhouse sink frame 30 in accordance with the embodiment of FIG. 8 has a recessed interior bottom surface 34', however, unlike the prior embodiments of the present invention, the interior bottom surface 34' is accessible through the top of the farmhouse sink frame 30. Further, the sink mounting aperture 36' which is at least partially defined by inner periphery 37' is configured in the shape of a sink basin. As before, a farmhouse sink frame 30 may be constructed of any of a number of materials of constructions including, but not limited to, fireclay, cast iron, porcelain, quartz, granite, or marble, just to name a few. In at least one embodiment, a farmhouse sink frame 30 is constructed of an acrylic or other engineered plastic material.

To effect installation, a bonding agent is applied to the interior bottom surface 34' and along the sidewalls of the farmhouse sink frame 30, and the stainless steel sink 40 is inserted through the sink mounting aperture 36' until the rimless upper edge 48 of the stainless steel sink 40 is substantially coplanar with the top surface 32 of the farmhouse sink frame 30. Any voids between the upper rimless edge 48 of the stainless-steel sink 40 and the top surface 32 of the farmhouse sink frame 30 are filled in with boning agent. As before, after the bonding agent fully cures, sanding or grinding may be utilized to remove any rough edges or overspills, so as to assure a seamless interface between the upper rimless edge 48 of the stainless steel sink 40 and the top surface 32 of the farmhouse sink frame 30.

As will be appreciated by those of skill in the art, the top mounted rimless stainless-steel sink 40 in accordance with the illustrative embodiment of FIG. 8 may be utilized to retrofit an existing farmhouse sink. In particular, in at least one embodiment, the farmhouse sink frame 30 in accordance with the alternative illustrative embodiment of FIG. 8 comprises a used farmhouse sink basin 30. As before, a farmhouse sink may be constructed of any of a number of materials of constructions including, but not limited to, fireclay, cast iron, porcelain, quartz, granite, or marble, just to name a few. After years of use, the interior surfaces of a farmhouse sink shown signs of wear, sometimes even forming cracks and leaks. As such, the present invention may be utilized to revitalize and even repair an existing farmhouse sink via a top mounted rimless stainless-steel sink 40 sized for insertion and secure installation into an existing farmhouse sink basin 30.

As noted above, the present invention further comprises a method for the installation of a farmhouse sink system having a stainless-steel sink. More in particular, and with reference to the illustrative embodiment of FIG. 9, the present invention comprises a method the installation of a farmhouse sink system having a stainless-steel sink, generally as shown as at 100.

In accordance with at least one embodiment of the present invention, the present method 100 comprises fabricating a stainless-steel sink with a rimless upper edge 110, wherein the rimless upper edge defines an outer periphery there around. The present method 100 further comprises creating a sink mounting aperture through a farmhouse sink frame 120 between a top surface and an interior bottom surface, wherein the sink mounting aperture comprises an inner periphery dimensioned to receive an outer periphery of a rimless upper edge of a stainless steel sink therein.

With reference to the illustrative embodiment of FIG. 9, the present method 100 also comprises positioning at least one mounting bracket at a predetermined mounting depth 130 below the rimless upper edge of the stainless-steel sink. In at least one embodiment of the present method 100, a mounting bracket comprises a continuous mounting bracket which completely encircles a sidewall of the stainless-steel sink. In at least one further embodiment, the present method 100 comprises positioning a plurality of mounting brackets at a predetermined mounting depth 130 below the rimless upper edge of the stainless-steel sink.

The present method 100 further includes securely attaching at least one mounting bracket to the sidewall of the stainless-steel sink 140, wherein the at least one mounting bracket is positioned a predetermined mounting depth below the rimless upper edge of the stainless-steel sink. In one further embodiment, the present method 100 comprises securely attaching a plurality of mounting brackets to the sidewall of the stainless steel sink 140, wherein each of the plurality of mounting brackets is positioned a predetermined mounting depth below the rimless upper edge of the stainless steel sink.

Figure 9:
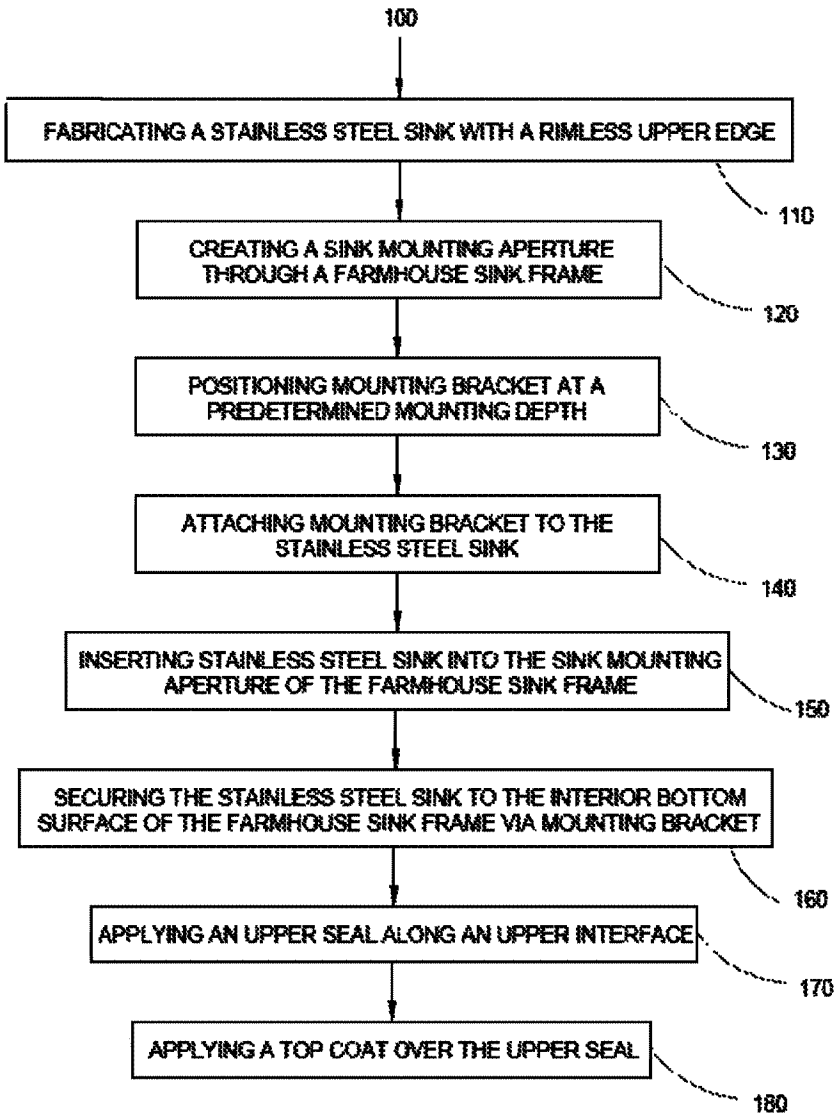
FIG. 9 is a block diagram illustrative of one method for the installation of a farmhouse sink system with a rimless stainless-steel sink in accordance with the present invention.

As may be seen from FIG. 9, the present method 100 also includes inserting the rimless upper edge of the stainless-steel sink through the interior bottom surface of the farmhouse sink frame and into the sink mounting aperture 150. In accordance with one further embodiment of the invention, the present method 100 includes securing the stainless-steel sink to the interior bottom surface of the farmhouse sink frame via at least one mounting bracket 160.

With reference once again to the illustrative embodiment of FIG. 9, the present method 100 further comprises applying an upper seal along an upper interface 170, wherein the upper seal is disposed between the rimless upper edge of the stainless steel sink and the inner periphery of the sink mounting aperture through the farmhouse sink frame. The upper seal prevents water, moisture, bacteria, and debris from entering between the rimless upper edge of the stainless-steel sink and the farmhouse sink frame.

In at least one further embodiment, the present method 100 comprises applying a top coat over the upper seal 180, so as to camouflage the presence of the upper seal. The top coat, in at least one embodiment, comprises a color matching acrylic, epoxy or polyester resin selected to simulate the color of the top surf ace of the farmhouse sink frame.

Since many modifications, variations and changes in detail can be made to the describe embodiments of the invention, it is intended that all matters in the foregoing description and shown in the accompanying drawings be interpreted as illustrative and not in a limiting sense. Thus, the scope of the invention should be determined by the appended claims and their legal equivalents.

Figure 10:
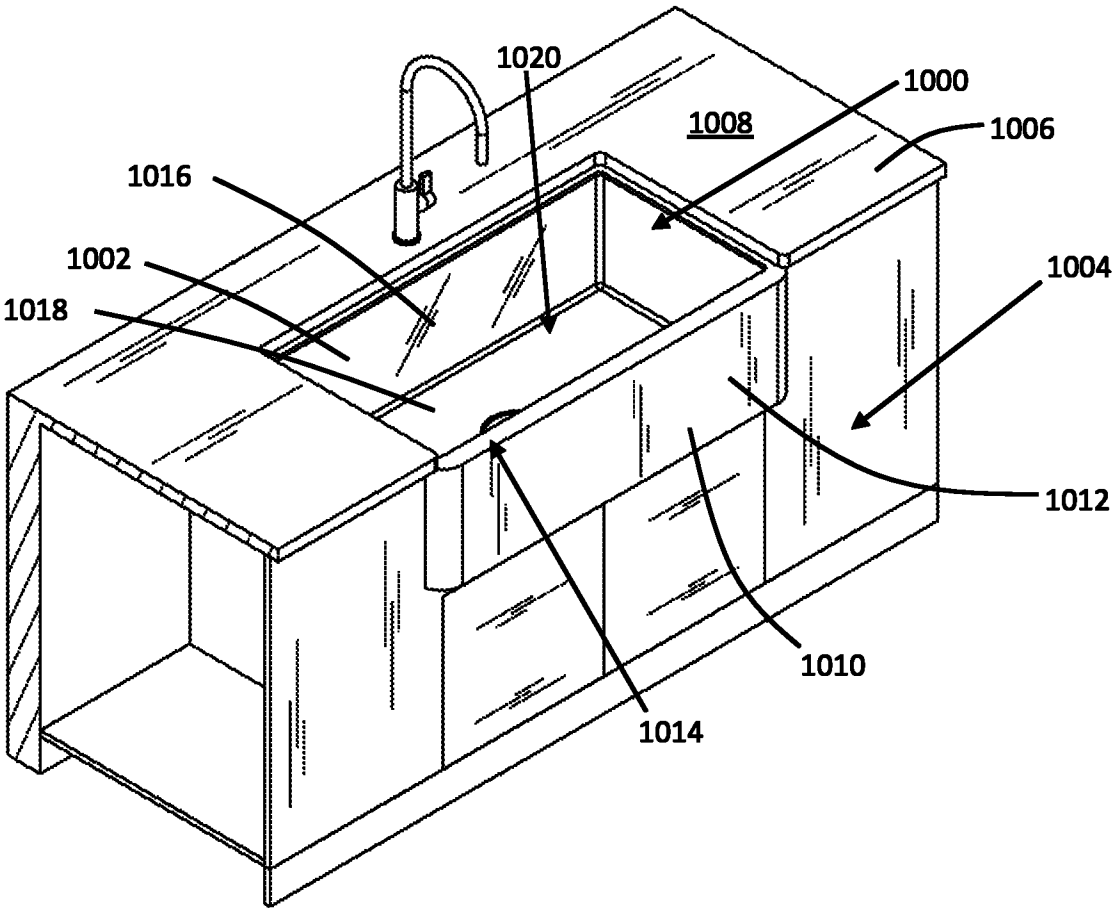
FIG. 10 a fragmentary perspective view of a cabinet assembly having a farmhouse sink system with a rimless metallic sink coupled thereto in accordance with one embodiment of the present invention.

Specifically, with reference to FIG. 10, another embodiment of the present invention is shown coupled with an existing cabinet assembly 1004 and countertop 1006 having many of the same, if not identical, features and functional described above. More specifically, the cabinet assembly 1004 may include a lower support surface 1210 and a plurality of cabinets with doors coupled thereto. The countertop 1006 includes an upper surface 1008, a lower surface 1200 coupled to the cabinet assembly 1004, and defines a sink access opening 1202 therethrough and spanning to the lower support surface 1210 of the cabinet assembly 1004. The farmhouse sink system 1000 with a rimless metallic sink 1002 is coupled to the cabinet assembly 1004 and countertop in a beneficial way that reduced the stress and other forces subjected on the countertop 1006 or adjacent structure of the cabinet assembly 1004 supporting the countertop 1006

Figure 11:
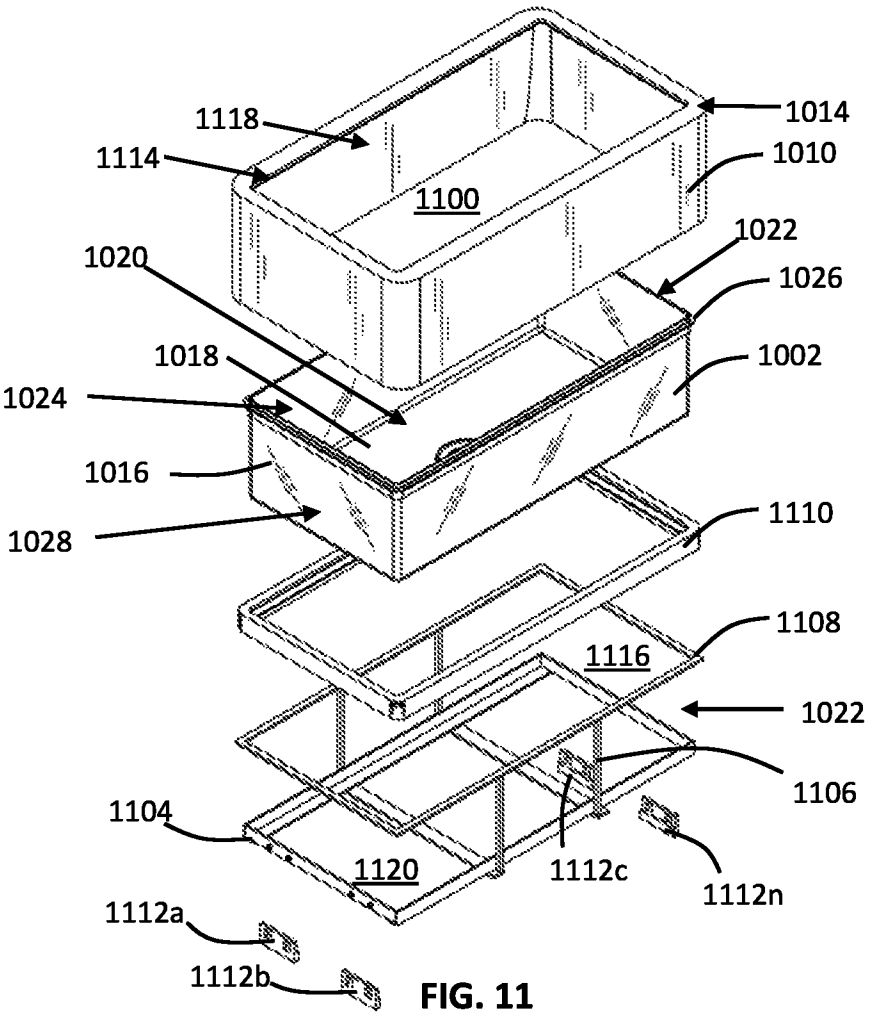
FIG. 11 an exploded view of the farmhouse sink system with the rimless metallic sink coupled thereto in accordance with one embodiment of the present invention.
Figure 12:
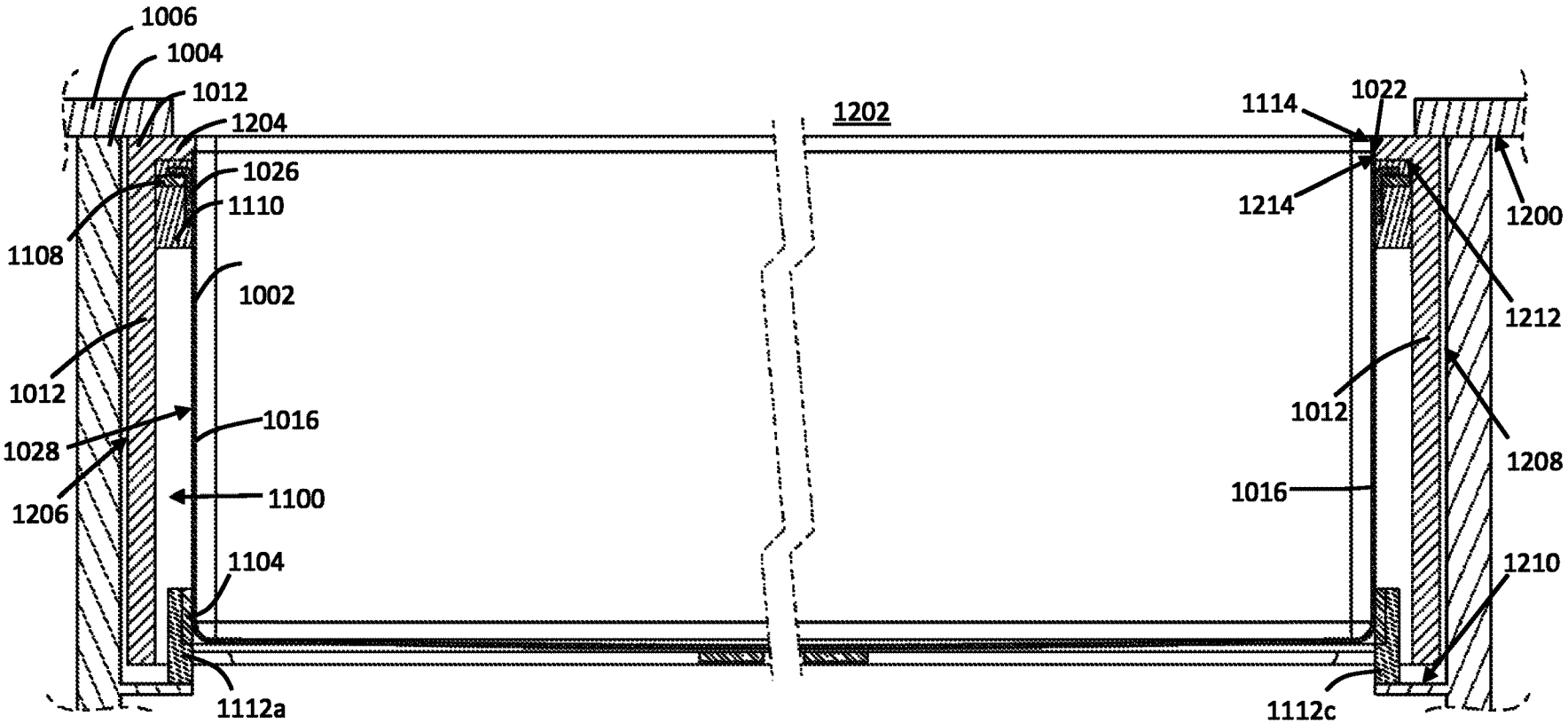
FIG. 12 a sectional view of the farmhouse sink system with the rimless metallic sink coupled to a cabinet assembly and countertop in accordance with one embodiment of the present invention.
Figure 13:
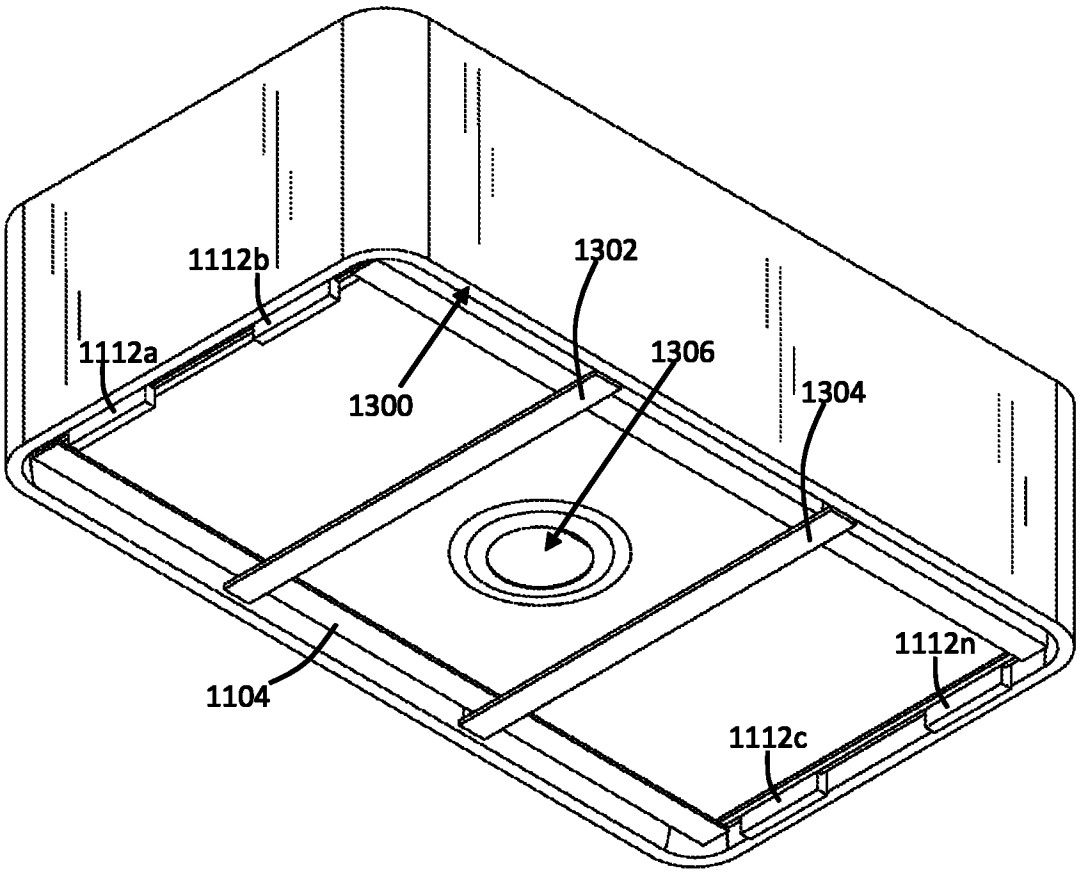
FIG. 13 a perspective bottom view of the farmhouse sink system with the rimless metallic sink coupled thereto in accordance with one embodiment of the present invention.
Figure 14:
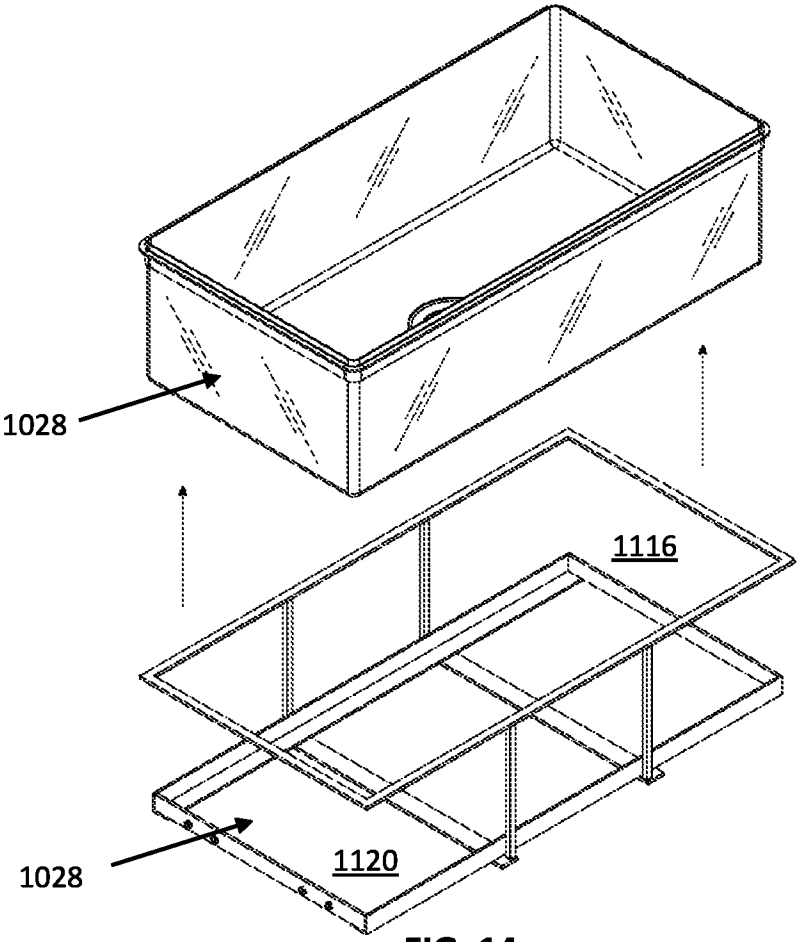
FIG. 14 a partially exploded view of the rimless metallic sink and the sink mounting frame assembly in accordance with one embodiment of the present invention.

FIGS. 11-12 depict an exploded and sectional view of the sink assembly, respectively. Said figures, along with the others depicted herein, show several advantageous features of the present invention, but, as will be described below, the invention can be provided in several shapes, sizes, combinations of features and components, and varying numbers and functions of the components. When installed on the cabinet assembly 1004 and countertop 1006, the farmhouse sink frame 1010 includes a sidewall 1012 with a top surface 1014 at least partially superimposed by and mounted below the lower surface 1200 of the countertop 1006. In some embodiments, the top surface 1014 of the sidewall 1012 may be visible from an overhead view of the farmhouse sink frame 1010 when installed. With reference to FIGS. 11-13, the sidewall 1012 includes a lower surface 1300 opposing the top surface 1014 of the sidewall 1012 of the farmhouse sink frame 1010 and defines a sink frame access opening 1100 therethrough. As discussed above, the farmhouse sink frame 1010 may be beneficially of a material such as quartz, natural stone, etc., i.e., different than the metallic sink 1002. The sink frame access opening 1100 may be partially or completely enclosed. The farmhouse sink frame 1010 beneficially includes an upper lip or flange 1204 extending laterally inward toward and terminating in the sink frame access opening 1100 on at least two opposing sides 1206, 1208 of the sidewall 1012 of the farmhouse sink frame 1010. In one embodiment, the upper lip 1204 is disposed at an upper terminal edge of the sidewall 1012 of the farmhouse sink frame 1010 and includes the top surface 1014 of the sidewall 1012 of the farmhouse sink frame 1010. Further, the upper lip 1204 may continuously surrounds an upper periphery or circumference of the farmhouse sink frame 1010. The lower surface 1300 of the sidewall 1012 of the farmhouse sink frame 1010 may continuously surrounds the lower periphery of the farmhouse sink frame 1010 and may define a planar surface that is configured to be flush with or proximal to (i.e., at or within 1-2 inches) a portion of the cabinet assembly 1004 (as depicted in FIG. 10).

Referring to FIGS. 11-13, the metallic sink 1002 is disposed within the sink frame access opening 1100, having a sidewall 1016 coupled to a bottom wall 1018 to define, with an inner sidewall surface 1024 of the sidewall 1016 of the metallic sink 1002, one or more bowls 1020. The sidewall 1016 may encloses the bottom wall 1018 and define the one or more bowls. As discussed above, the bottom wall 1018 may define a drain (centrally or otherwise located thereon) that is operably couplable to a plumbing assembly. The metallic sink 1002 is beneficially of a durable, resilient, substantially rigid, and/or water-resistant material such as a stainless steel or copper material. As used herein, the term "wall" is intended broadly to encompass continuous structures, as well as separate structures that are coupled together so as to form a substantially continuous external surface.

The metallic sink 1002 beneficially includes a mounting flange member 1026 laterally extending outwardly from an outer sidewall surface 1028 of the sidewall 1016 of the metallic sink 1002. In one embodiment, the mounting flange member 1026 may extend continuously (or discontinuously) around a circumference or perimeter of the outer sidewall surface 1028 of the sidewall 1016 of the metallic sink 1002. The mounting flange member 1026 may also be partially located and disposed on two opposing sides of the sidewall 1016 of the metallic sink 1002.

The metallic sink 1002 also includes a rimless upper edge 1022 (as shown in the figures) disposed along and around the sidewall 1016 of the metallic sink 1002 and that is beneficially superimposed by the upper lip 1204 of the farmhouse sink frame 1010. In one embodiment, the mounting flange member 1026 is recessed uniformly below the rimless upper edge 1022, e.g., a distance of approximately 1-3 inches. In some embodiment, the mounting flange member 1026 is located proximal to the rimless upper edge 1022. The mounting flange member 1026 may be pre-formed with the sidewall 1016 of the metallic sink 1002 or may be directly coupled thereto using mechanical methods such as fasteners or welding. In one embodiment, the upper lip 1204 includes an inner periphery surface 1114 at least partially defining the sink access opening 1202, whereby the upper lip 1204 defines a lip channel 1214 (approximately of a depth matching the thickness of the sidewall 1016 of the metallic sink 1002). The lip channel 1214 may span inwardly into the upper lip 1204 from the inner periphery surface 1114 and have the rimless upper edge 1022 disposed therein, thereby giving an outer appearance that discreetly conceals the rimless upper edge 1022.

Beneficially and with reference to FIGS. 11-14, the assembly may utilize a sink mounting frame assembly 1102. In one embodiment, the sink mounting frame assembly 1102 may consist of a plurality of frame members that are substantially rigid and may be separately formed and coupled together or uniformly and pre-formed together. For example, the sink mounting frame assembly 1102 may include a metallic lower horizontally oriented frame member 1104 disposed proximal (as defined above) to the lower support surface 1210 of the cabinet assembly 1004 and a longitudinally oriented metallic frame member 1106 separating and vertically displacing, with respect to the lower horizontally oriented frame member 1104, an upper horizontally oriented metallic frame member 1108 that is directly coupled to the mounting flange member 1026. In one embodiment, the metallic lower horizontally oriented frame member 1104 encloses and defines a lower frame aperture 1120 and may include one or more lateral support frame elements 1302, 1304 that flank and provide access to the drain 1406.

The upper horizontally oriented metallic frame member 1108 may also enclose and define an upper frame aperture 1116 for the metallic sink 1002 to be received and disposed therein. As seen best in FIG. 12, the mounting flange member 1026 is seated around a perimeter of the upper horizontally oriented metallic frame member 1108. As such, the weight of the metallic sink 1002 may be principally supported by the sink mounting frame assembly 1102 and, if utilized, one or more support footings 1112*a-n* that may be directly coupled to the lower horizontally oriented frame member 1104 or other part of the sink mounting frame assembly 1102.

More specifically, as best seen in FIGS. 11-14, the one or more support footings 1112*a-n* may be directly coupled to the lower support surface 1210 of the cabinet assembly 1004, which takes the weight of the metallic sink 1002 and other components of the assembly. As such, the plurality of support footings 1112*a-n* are of a substantially rigid material operably configured to withstand the weight of the metallic sink 1002 and other components of the assembly without failure, e.g., stainless steel, ceramic, stone, etc. In one embodiment, the lower support surface 1210 of the cabinet assembly 1004 supports at least 90% of an overall weight (e.g., approximately 80-100 lbs) defined by the farmhouse sink frame 1010, metallic sink 1002, and metallic sink mounting frame assembly 1102. The lower support 1210 may be material forming the enclosed cabinet floor, 2×4 (or other dimension) wood plank, etc.

The plurality of support footings 1112*a-n* may be coupled or fastened to and/or selectively translatably coupled to the lower horizontally oriented frame member 1104 using one or more fastener(s) (as depicted best in FIG. 11). In some embodiments, the plurality of support footings 1112*a-n* may be movable up and down longitudinally using a tongue-and-groove coupling configuration.

Referring back to FIGS. 11-12, the upper horizontally oriented metallic frame member 1108 can be seen as coupled to the sidewall 1012 and upper lip 1204 of the farmhouse sink frame 1010 through an adhesive bonding layer 1110, thereby forming a unitary structure, i.e., said structures move as one unit. The adhesive bonding layer 1110 may surround at least a portion of the upper horizontally oriented metallic frame member 1108 and the mounting flange member 1026. Further, the adhesive bonding layer 1110 is directly coupled to a lower surface 1212 of the upper lip 1204 and is of thickness of approximately 1-2 inches. Therefore, an inventive and effective system for utilizing a farmhouse sink system with a rimless metallic sink has been disclosed and depicted.

Figure 15:
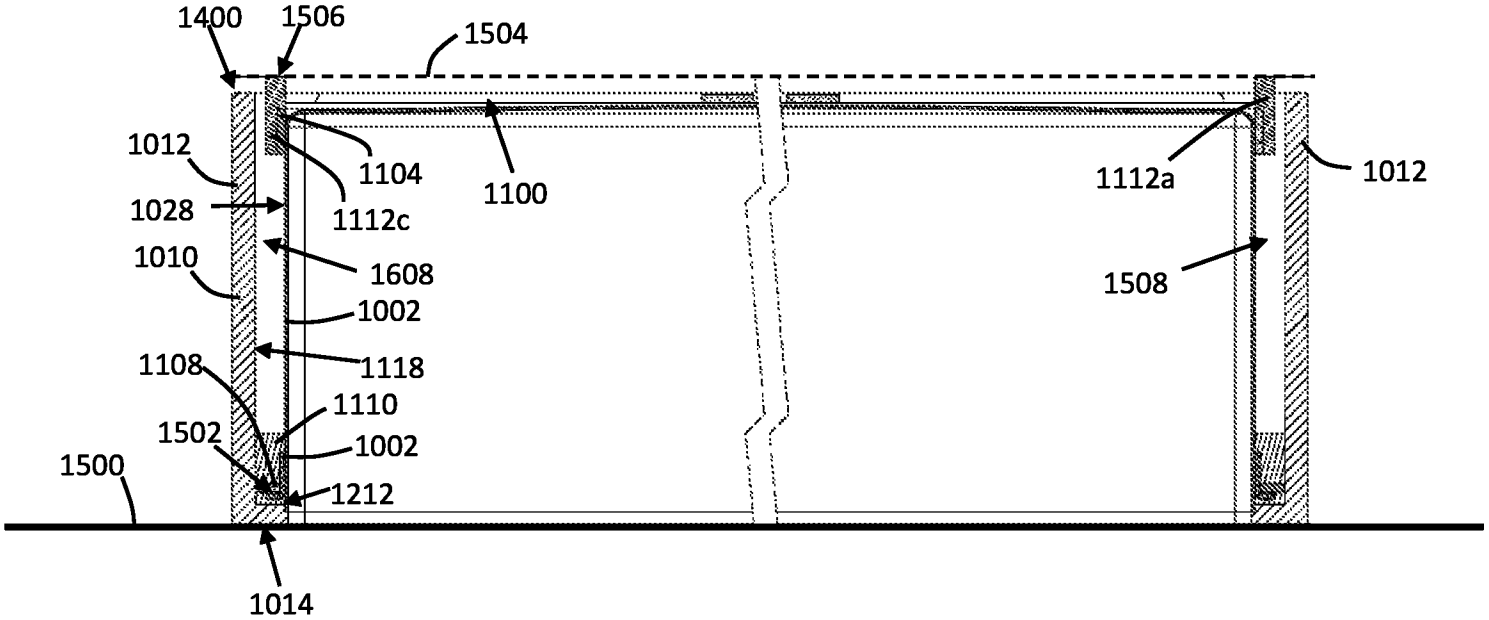
FIG. 15 a sectional view of the farmhouse sink system with the rimless metallic sink coupled thereto and disposed in an installation configuration and position in accordance with one embodiment of the present invention.
Figure 16:
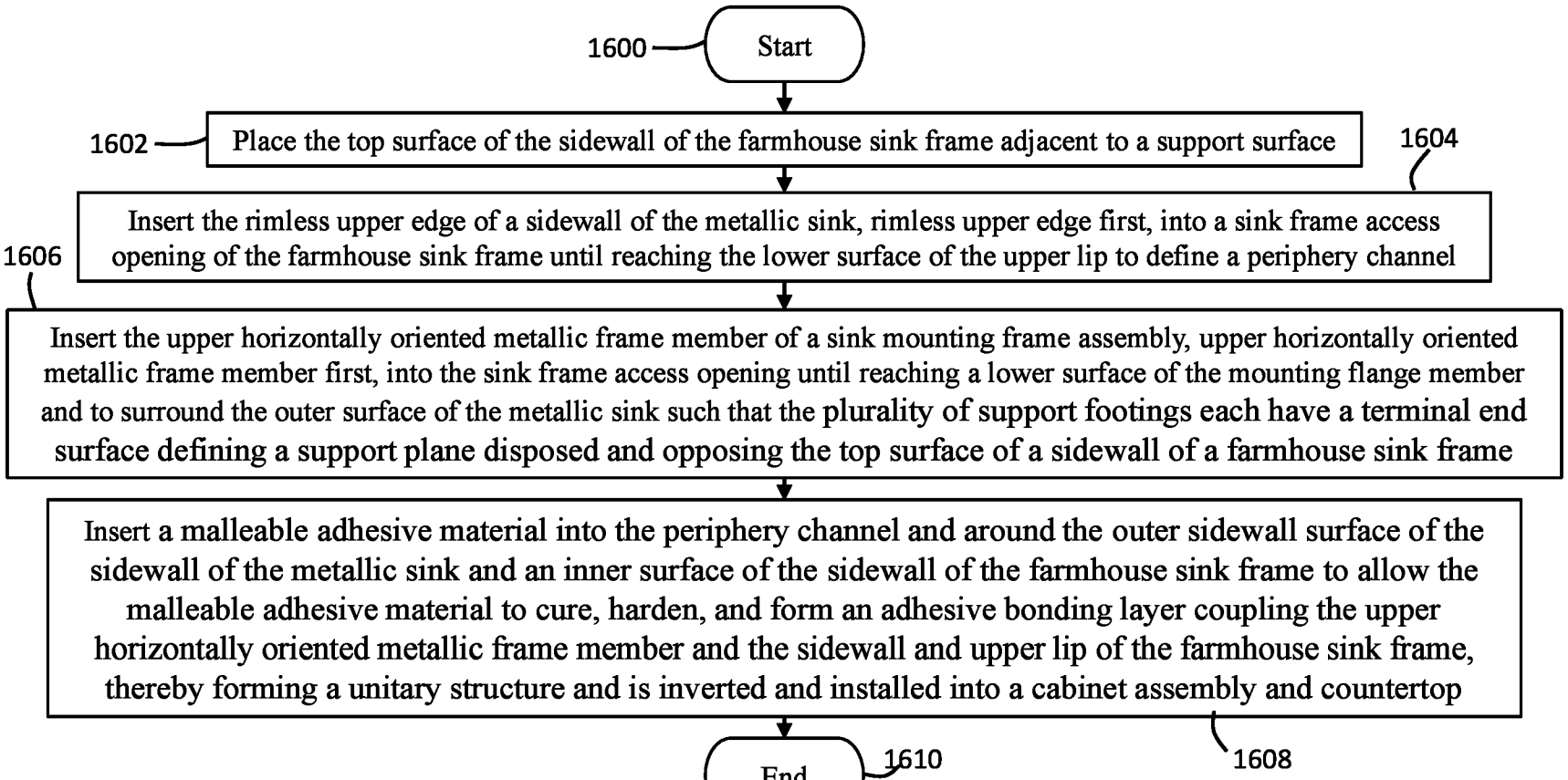
FIG. 16 a process flow diagram depicting a method of forming a farmhouse sink system with a rimless metallic sink in accordance with one embodiment of the present invention.

FIG. 11 and FIG. 15 will be described in conjunction with the process flow chart of FIG. 16. Although FIG. 16 shows a specific order of executing the process steps, the order of executing the steps may be changed relative to the order shown in certain embodiments. Also, two or more blocks shown in succession may be executed concurrently or with partial concurrence in some embodiments. Certain steps may also be omitted in FIG. 16 for the sake of brevity. In some embodiments, some or all of the process steps included in FIG. 16 can be combined into a single process.

More specifically, a method of forming a farmhouse sink system 1000 with a rimless metallic sink 1002 is disclosed in FIG. 16 that begins at step 1600 and immediately proceeds to the step 1602 providing and placing the top surface 1014 of a sidewall 1012 of a farmhouse sink frame 1010 adjacent to a support surface 1500. Said another way and as depicted best in comparison to FIG. 11, the assembly is formed by first inverting the farmhouse sink frame 1010 180° relative to its installed position. The farmhouse sink frame has a lower surface 1300 opposing the top surface 1014 of the sidewall 1012 of the farmhouse sink frame 1010 and vertically displaced a length from the support surface 1500, defining a sink frame access opening 1100 therethrough, and an upper lip 1204 extending laterally inward toward the sink frame access opening 1100 on at least two opposing sides 1206, 1208 of the sidewall 1012 of the farmhouse sink frame 1010, wherein the upper lip 1204 has a lower surface 1212.

Next, the process moves to step 1604 of inserting a rimless upper edge 1022 of a sidewall 1016 of a metallic sink 1002, rimless upper edge 1022 first, into the sink frame access opening 1100 until reaching the lower surface 1212 of the upper lip 1204 to define a periphery channel 1508. The periphery channel 1508 may completely surround the perimeter of the sidewall 1016 of the metallic sink 1002 or may be located on one or more sides thereof. The sidewall 1016 of the metallic sink 1002 is coupled to a bottom wall 1018 to define and enclose, with an inner sidewall surface 1024 of the sidewall 1016 of the metallic sink 1002, at least one bowl 1020, and has a mounting flange member 1026 laterally extending outwardly from an outer sidewall surface 1028 of the sidewall 1016 of the metallic sink 1002. The rimless upper edge 1022 may be disposed along and around the sidewall 1016 of the metallic sink 1002 or otherwise as described above.

Next, the process moves to step 1606 of inserting an upper horizontally oriented metallic frame member 1108 of a sink mounting frame assembly 1102, upper horizontally oriented metallic frame member 1108 first, into the sink frame access opening 1100 until reaching a lower surface 1502 of the mounting flange member 1026 and to surround the outer surface 1028 of the metallic sink 1002. As seen best in FIG. 14, a significant portion or longitudinal length of the sink 1002 extends or is otherwise disposed through both the upper frame aperture 1116 and the lower frame aperture 1120. The sink mounting frame assembly 1102 has a metallic lower horizontally oriented frame member 1104 and a longitudinally oriented metallic frame member 1106 separating and vertically displacing, with respect to the lower horizontally oriented frame member 1104, wherein the upper horizontally oriented metallic frame member 1108 and the sink mounting frame assembly 1022 may have a plurality of support footings 1112*a-n* each directly coupled to the lower horizontally oriented frame member 1104. The one or more support footing(s) 1112*a-n* may each have a terminal end surface 1506 defining a support plane 1504 disposed and opposing the top surface 1014 of a sidewall 1012 of a farmhouse sink frame 1010. In one embodiment, four support footings 1112*a-n* are utilized and may be adjustable or set to a particular height of the overall assembly that allows the top surface 1014 of a sidewall 1012 of a farmhouse sink frame 1010 to be flush with the underneath surface of the countertop.

Next, the process to step 1608 of inserting a malleable adhesive material 1110 (as discussed above, e.g., liquid acrylic, epoxy, or another type of bonding age) into the periphery channel 1508 and around the outer sidewall surface 1028 of the sidewall 1016 of the metallic sink 1002 and an inner surface 1118 of the sidewall 1012 of the farmhouse sink frame 1010. The thickness of the periphery channel 1508 may vary but may be approximately 1-3 inches in length uniformly spanning around the outer sidewall surface 1028 of the sidewall 1016. While still inverted in the position shown in FIG. 15, the malleable adhesive material is allowed to cure, harden, and form an adhesive bonding layer 1110 coupling the upper horizontally oriented metallic frame member 1108 and the sidewall 1012 and upper lip 1204 of the farmhouse sink frame 1010, thereby forming a unitary structure. The unitary structure is then ready for installation as described above without damaging or transferring significant weight to the countertop. The edges where the top surface 1014 of a sidewall 1012 of a farmhouse sink frame 1010 meet the countertop or cabinet may be finished off with a sealing material, such as caulking.

Various modifications and additions can be made to the exemplary embodiments discussed without departing from the scope of the present disclosure. For example, while the embodiments described above refer to particular features, the scope of this disclosure also includes embodiments having different combinations of features and embodiments that do not include all of the above described features.

What is claimed is:

1. A farmhouse sink system with a rimless metallic sink comprising:

a cabinet assembly having a lower support surface;

a countertop having an upper surface, a lower surface coupled to the cabinet assembly, and defining a sink access opening therethrough and spanning to the lower support surface of the cabinet assembly;

a farmhouse sink frame having a sidewall with a top surface at least partially superimposed by and mounted below the lower surface of the countertop, with a lower surface opposing the top surface of the sidewall of the farmhouse sink frame, defining a sink frame access opening therethrough, and an upper lip extending laterally inward toward the sink frame access opening on at least two opposing sides of the sidewall of the farmhouse sink frame;

a metallic sink disposed within the sink frame access opening, having a sidewall coupled to a bottom wall to define, with an inner sidewall surface of the sidewall of the metallic sink, at least one bowl, having a mounting flange member laterally extending outwardly from an outer sidewall surface of the sidewall of the metallic sink, and having a rimless upper edge disposed along and around the sidewall of the metallic sink and superimposed by the upper lip of the farmhouse sink frame; and a sink mounting frame assembly with a metallic lower horizontally oriented frame member disposed proximal to the lower support surface of the cabinet assembly and a longitudinally oriented metallic frame member separating and vertically displacing, with respect to the lower horizontally oriented frame member, an upper horizontally oriented metallic frame member directly coupled to the mounting flange member.

2. The farmhouse sink system with a rimless metallic sink according to claim 1, wherein:

the upper horizontally oriented metallic frame member is coupled to the sidewall and upper lip of the farmhouse sink frame through an adhesive bonding layer, thereby forming a unitary structure.

3. The farmhouse sink system with a rimless metallic sink according to claim 2, wherein:

the adhesive bonding layer surrounds at least a portion of the upper horizontally oriented metallic frame member and the mounting flange member.

4. The farmhouse sink system with a rimless metallic sink according to claim 3, wherein:

the adhesive bonding layer is directly coupled to a lower surface of the upper lip and is of thickness of approximately 1-2 inches.

5. The farmhouse sink system with a rimless metallic sink according to claim 2, wherein the upper lip further comprises:

an inner periphery surface at least partially defining the sink access opening, the upper lip defining a lip channel spanning inwardly into the upper lip from the inner periphery surface and having the rimless upper edge disposed therein.

6. The farmhouse sink system with a rimless metallic sink according to claim 1, wherein:

the mounting flange member extends continuously around a circumference of the outer sidewall surface of the sidewall of the metallic sink.

7. The farmhouse sink system with a rimless metallic sink according to claim 6, wherein:

the upper horizontally oriented metallic frame member encloses and defines an upper frame aperture with the metallic sink disposed therein and with the mounting flange member seated around a perimeter of the upper horizontally oriented metallic frame member.

8. The farmhouse sink system with a rimless metallic sink according to claim 6, wherein:

the mounting flange member is recessed uniformly below the rimless upper edge.

9. The farmhouse sink system with a rimless metallic sink according to claim 1, wherein the lower support surface of the cabinet assembly supports at least 90% of an overall weight defined by the farmhouse sink frame, metallic sink, and metallic sink mounting frame assembly.

10. The farmhouse sink system with a rimless metallic sink according to claim 1, further comprising:

a plurality of support footings directly coupled to the lower horizontally oriented frame member and directly coupled to the lower support surface of the cabinet assembly.

11. The farmhouse sink system with a rimless metallic sink according to claim 10, wherein:

the plurality of support footings are of a substantially rigid material and selectively translatably coupled to the lower horizontally oriented frame member.

12. The farmhouse sink system with a rimless metallic sink according to claim 1, wherein:

the upper lip is disposed at an upper terminal edge of the sidewall of the farmhouse sink frame and includes the top surface of the sidewall of the farmhouse sink frame that continuously surrounds an upper periphery of the farmhouse sink frame.

13. The farmhouse sink system with a rimless metallic sink according to claim 1, wherein:

the sidewall encloses the bottom wall defining the at least one bowl.

14. The farmhouse sink system with a rimless metallic sink according to claim 1, wherein:

the metallic sink is either of a stainless steel or copper material.

15. A farmhouse sink system with a rimless metallic sink comprising:

a farmhouse sink frame having a sidewall with a top surface for mounting underneath a lower surface of a countertop, with a lower surface opposing the top surface of the sidewall of the farmhouse sink frame, defining a sink frame access opening therethrough, and an upper lip extending laterally inward toward the sink frame access opening on at least two opposing sides, of the sidewall of the farmhouse sink frame;

a metallic sink disposed within the sink frame access opening, having a sidewall coupled to a bottom wall to define and enclose, with an inner sidewall surface of the sidewall of the metallic sink, at least one bowl, having a mounting flange member laterally extending outwardly from an outer sidewall surface of the sidewall of the metallic sink, and having a rimless upper edge disposed along and around the sidewall of the metallic sink and superimposed by the upper lip of the farmhouse sink frame; and a sink mounting frame assembly with a metallic lower horizontally oriented frame member and a longitudinally oriented metallic frame member separating and vertically displacing, with respect to the lower horizontally oriented frame member, an upper horizontally oriented metallic frame member directly coupled to the mounting flange member, the upper horizontally oriented metallic frame member coupled to the sidewall and upper lip of the farmhouse sink frame through an adhesive bonding layer, thereby forming a unitary structure.

16. The farmhouse sink system with a rimless metallic sink according to claim 15, wherein:

the adhesive bonding layer surrounds at least a portion of the upper horizontally oriented metallic frame member and the mounting flange member.

17. The farmhouse sink system with a rimless metallic sink according to claim 16, wherein:

the adhesive bonding layer is directly coupled to a lower surface of the upper lip and is of thickness of approximately 1-2 inches.

18. The farmhouse sink system with a rimless metallic sink according to claim 15, wherein the upper lip further comprises:

an inner periphery surface at least partially defining the sink access opening, the upper lip defining a lip channel spanning inwardly into the upper lip from the inner periphery surface and having the rimless upper edge disposed therein.

19. A method of forming a farmhouse sink system with a rimless metallic sink comprising the steps of:

placing a top surface of a sidewall of a farmhouse sink frame adjacent to a support surface, the farmhouse sink frame having a lower surface opposing the top surface of the sidewall of the farmhouse sink frame and vertically displaced a length from the support surface, defining a sink frame access opening therethrough, and an upper lip extending laterally inward toward the sink frame access opening on at least two opposing sides of the sidewall of the farmhouse sink frame, the upper lip having a lower surface;

inserting a rimless upper edge of a sidewall of a metallic sink, rimless upper edge first, into the sink frame access opening until reaching the lower surface of the upper lip to define a periphery channel, the sidewall of the metallic sink coupled to a bottom wall to define and enclose, with an inner sidewall surface of the sidewall of the metallic sink, at least one bowl, and having a mounting flange member laterally extending outwardly from an outer sidewall surface of the sidewall of the metallic sink, the rimless upper edge disposed along and around the sidewall of the metallic sink; and inserting an upper horizontally oriented metallic frame member of a sink mounting frame assembly, upper horizontally oriented metallic frame member first, into the sink frame access opening until reaching a lower surface of the mounting flange member and to surround the outer surface of the metallic sink, the sink mounting frame assembly having a metallic lower horizontally oriented frame member and a longitudinally oriented metallic frame member separating and vertically displacing, with respect to the lower horizontally oriented frame member, the upper horizontally oriented metallic frame member and the sink mounting frame assembly having a plurality of support footings each directly coupled to the lower horizontally oriented frame member and each having a terminal end surface defining a support plane disposed and opposing the top surface of a sidewall of a farmhouse sink frame, and;

inserting a malleable adhesive material into the periphery channel and around the outer sidewall surface of the sidewall of the metallic sink and an inner surface of the sidewall of the farmhouse sink frame and allowing the malleable adhesive material to cure, harden, and form an adhesive bonding layer coupling the upper horizontally oriented metallic frame member and the sidewall and upper lip of the farmhouse sink frame, thereby forming a unitary structure.

* * * * *